US007062991B1

(12) United States Patent
West et al.

(10) Patent No.: US 7,062,991 B1
(45) Date of Patent: Jun. 20, 2006

(54) TUBULAR CONNECT/DISCONNECT APPARATUS

(75) Inventors: Neil Edward West, Corona, CA (US); Preston R. Fox, Fountain Valley, CA (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 11/317,627

(22) Filed: Dec. 23, 2005

(51) Int. Cl.
*B25B 13/50* (2006.01)

(52) U.S. Cl. ..... 81/57.16; 81/57.19; 81/57.34

(58) Field of Classification Search ..... 81/57.15, 81/57.16, 57.18, 57.19, 57.2, 57.22, 57.33, 81/57.34, 57.35, 57.36
See application file for complete search history.

(56) References Cited

U.S. PATENT DOCUMENTS 5,271,298 A * 12/1993 Gazel-Anthoine ..... 81/57.16
6,829,968 B1 * 12/2004 Hauk et al. ..... 81/57.16

* cited by examiner

*Primary Examiner*—Jacob K. Ackun, Jr.
(74) *Attorney, Agent, or Firm*—Guy McClung

(57) ABSTRACT

An apparatus for rotating a tubular, the apparatus, in at least certain aspects including a frame, a rocker assembly connected to the frame, the rocker assembly including a top rocker arm pivotably mounted to the frame, and a bottom rocker arm pivotably mounted to the frame, top torque apparatus connected to the frame, upper gripper apparatus connected to the frame for gripping a primary tubular (e.g., but not limited to a first pipe), lower gripper apparatus connected to the frame for gripping a secondary member (e.g., but not limited to a second pipe threadedly connected to or to be threadedly connected to the first pipe; or part of a bit to be connected to or unconnected from a tubular), the upper gripper apparatus and lower gripper apparatus operable so that the lower gripper apparatus grips and holds the secondary member while the upper gripper apparatus grips and holds the primary tubular as the top torque apparatus is rotatable to rotate the primary tubular with respect to the secondary member, and torque generated by the top torque apparatus reacted through the upper gripper apparatus, through the top rocker arm, through the bottom rocker arm, and to the lower gripper apparatus; and methods for using such an apparatus.

20 Claims, 15 Drawing Sheets

FIG. 9A
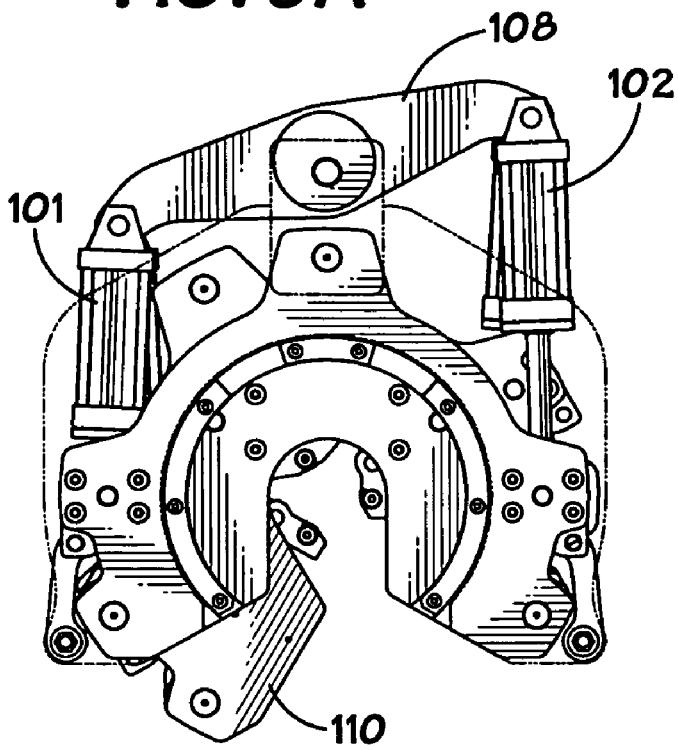
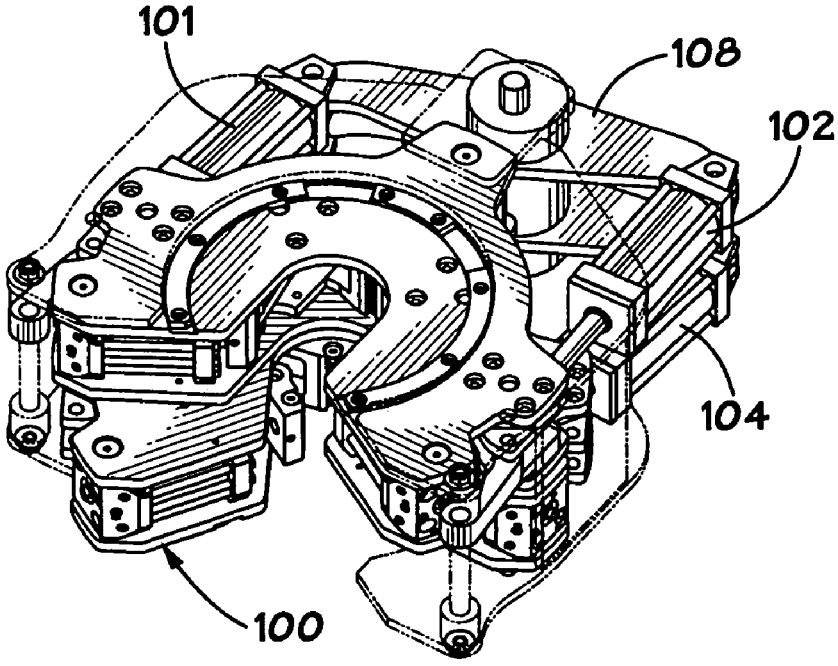
FIG. 9B

TUBULAR CONNECT/DISCONNECT APPARATUS

BACKGROUND OF THE INVENTION

1. Field of the Invention

The present invention is directed to apparatuses for connecting and disconnecting tubular members (e.g. casing, tubing, pipe, or drill pipe) and, in certain particular aspects to iron roughnecks, tongs, and methods of their use.

2. Description of Related Art

"Iron roughnecks," which combine a torque wrench and a spinning wrench, have been used for connecting and disconnecting various tubulars, e.g. drilling components, such as drill pipe, in running a string of drill pipe or other pipe into or out of a well. The prior art includes a variety of iron roughnecks; see e.g. U.S. Pat. Nos. 4,023,449, 4,348,920, 4,765,401, 6,776,070, all of which are incorporated herein by reference in their entirety.

Various prior art iron roughnecks have a spinning wrench and a torque wrench mounted together on a carriage. For making or breaking threaded connections between two tubulars, e.g. joints of drill pipe, certain iron roughnecks have a torque wrench with two jaw levels. An upper jaw of the torque wrench is used to clamp onto a portion of an upper tubular, and a lower jaw clamps onto a portion of a lower tubular, e.g. upper and lower threadedly connected pieces of drill pipe. After clamping onto a tubular, the upper and lower jaws are turned relative to each other to break or make a connection between the upper and lower tubulars. A spinning wrench, mounted on the carriage above the torque wrench, engages the upper tubular and spins it until it is disconnected from the lower tubular (or in a connection operation, spins two tubulars together prior to final make-up by the torque wrench).

Certain iron roughnecks are mounted for movement from a wellbore center to a retracted position which does not interfere with or block performance of other operations relative to the well and rotating or driving apparatuses. Such a prior art system can be used for making and breaking joints in a main string or for connecting to or disconnecting from a tubular section located apart from a wellbore center, e.g. in a mousehole (or rathole) at a side of a well.

Certain prior art iron roughneck systems include a carriage for rolling on the surface of the rig floor along a predetermined path. In certain prior art systems a spinner and torque wrench are mounted for upward and downward movement relative to a carriage, for proper engagement with tubulars, and for tilting movement between a position in which their axis extends directly vertically for engagement with a vertical well pipe and a position in which the axis of the spinner and torque wrench is disposed at a slight angle to true vertical to engage and act against a pipe in an inclined mousehole. In certain prior art systems, a spinner is movable vertically with respect to a torque wrench.

With a variety of non-shouldering connections, including, but not limited to, wedge thread connections, various prior art iron roughnecks are able to rotate a tubular through an arc ranging between about 28° and 30°. However, accurate full make up of a joint between two non-shouldering connections often requires that one tubular be rotated more than 30° to form a good connection. In order to provide the additional rotation, these prior art systems have to unclamp, re-position jaws, clamp again, and rotate again (and, perhaps, do this several times).

Several prior art iron roughnecks and tongs can distort or damage thin-walled tubulars due to the fact that they employ two opposed jaws to clamp a tubular. With other prior art systems, a spinner may spin a tubular's pin end into a box, but, due to a relatively long tapered pin desired shouldering of the connection may not be achieved and re-clamping of the tubulars with the torque wrench and again rotating one of the tubulars may be required.

The prior art discloses a variety of tongs for use in wellbore operations, e.g., but not limited to, as disclosed in and referred to in U.S. Pat. Nos. 6,684,737; 6,971,283; 5,161,438; 5,159,860; 5,842,390; 5,245,877; 5,259,275; 5,390,568; 4,346,629; 5,044,232; 5,081,888; 5,167,173; 5,207,128; 5,409,280; 5,868,045; 6,966,385; 6,138,529; 4,082,017; 6,082,224; 6,213,216; 6,330,911; 6,668,684; 6,752,044; 6,318,214; and 6,142,041. Several prior art tongs employ two opposed grippers which apply forces to a tubular in such a manner that the tubular can be distorted or damaged.

There is a need, recognized by the present inventors, for an effective and efficient tubular gripping system which minimizes distortion of a tubular.

There is a need, recognized by the present inventors, for an effective and efficient iron roughnecks and tongs which can operate on a wide variety of tubulars.

There is a need, recognized by the present inventors, for an effective and efficient iron roughnecks and tongs which can finalize a threaded connection with a minimum of clamping steps.

SUMMARY OF THE PRESENT INVENTION

The present invention, in certain embodiments, provides an apparatus for rotating a tubular, the apparatus including a frame, a rocker assembly connected to the frame, the rocker assembly including a top rocker arm pivotably mounted to the frame, and a bottom rocker arm pivotably mounted to the frame, top torque apparatus connected to the frame, upper gripper apparatus connected to the frame for gripping a primary tubular, lower gripper apparatus connected to the frame for gripping a secondary member, the upper gripper apparatus and lower gripper apparatus operable so that the lower gripper apparatus grips and holds the secondary member while the upper gripper apparatus grips and holds the primary tubular as the top torque apparatus is rotatable to rotate the primary tubular with respect to the secondary member, and torque generated by the top torque apparatus reacted through the upper gripper apparatus, through the top rocker arm, through the bottom rocker arm, and to the lower gripper apparatus.

The present invention, in certain embodiments, provides a tubular handling system for connecting and disconnecting threaded connections between tubular members, the system including a spinner and a torque wrench mounted on a movable carriage, the torque wrench having an upper jaw assembly and a lower jaw assembly. In certain particular aspects, the system is able to rotate a tubular through an arc of about sixty degrees in one operation.

In certain aspects, in such a system both the upper and the lower jaw assemblies of the torque wrench have three movable die carriers which are equally spaced around a tubular to grip the tubular and to reduce distortion of the tubular.

In one particular aspect either the upper or the lower jaw assembly is securable to a frame that houses the jaw assemblies so that either jaw assembly can be used to rotate a tubular. In one aspect, the three die carriers are moved simultaneously and assist in centering a tubular within the system.

In certain embodiments torque cylinders used to rotate the die carriers are interconnected via a rocker arm apparatus that allows forces of one die carrier (of an upper or lower jaw assembly) to be reacted through the rocker arm apparatus to another die carrier or carriers of a different level jaw assembly. Such a rocker arm assembly can also facilitate achieving a discrete actual centering of a tubular within the jaws.

In a particular embodiment, a system according to the present invention is useful for connection making and breaking as well as for bit breaking.

It is, therefore, an object of at least certain preferred embodiments of the present invention to provide new, useful, unique, efficient, non-obvious systems and methods for making and breaking threaded connections between tubular members.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 9A is a top view of the torque wrench of FIG. 2A.

FIG. 9B is a perspective view of the torque wrench of FIG. 2A.

DESCRIPTION OF EMBODIMENTS PREFERRED AT THE TIME OF FILING FOR THIS PATENT

Figure 1A:
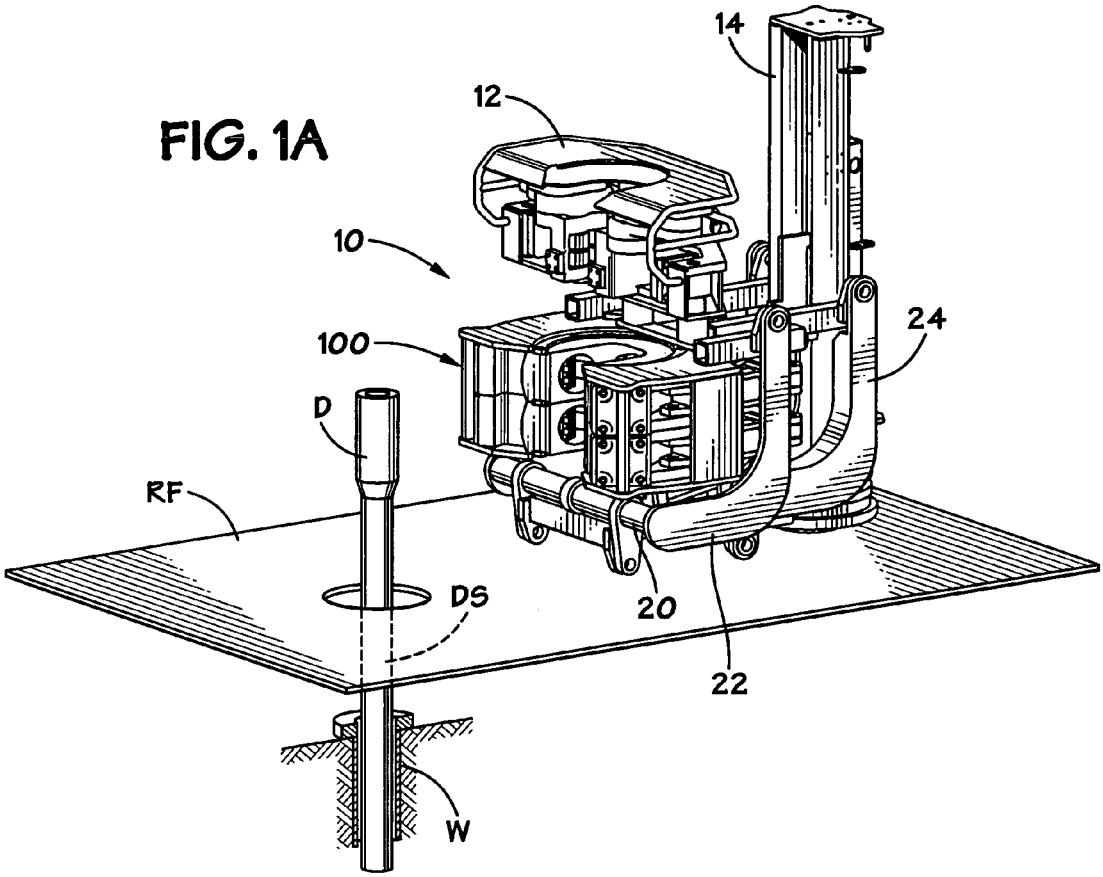
FIG. 1A is a perspective view of a system according to the present invention.
Figure 1D:
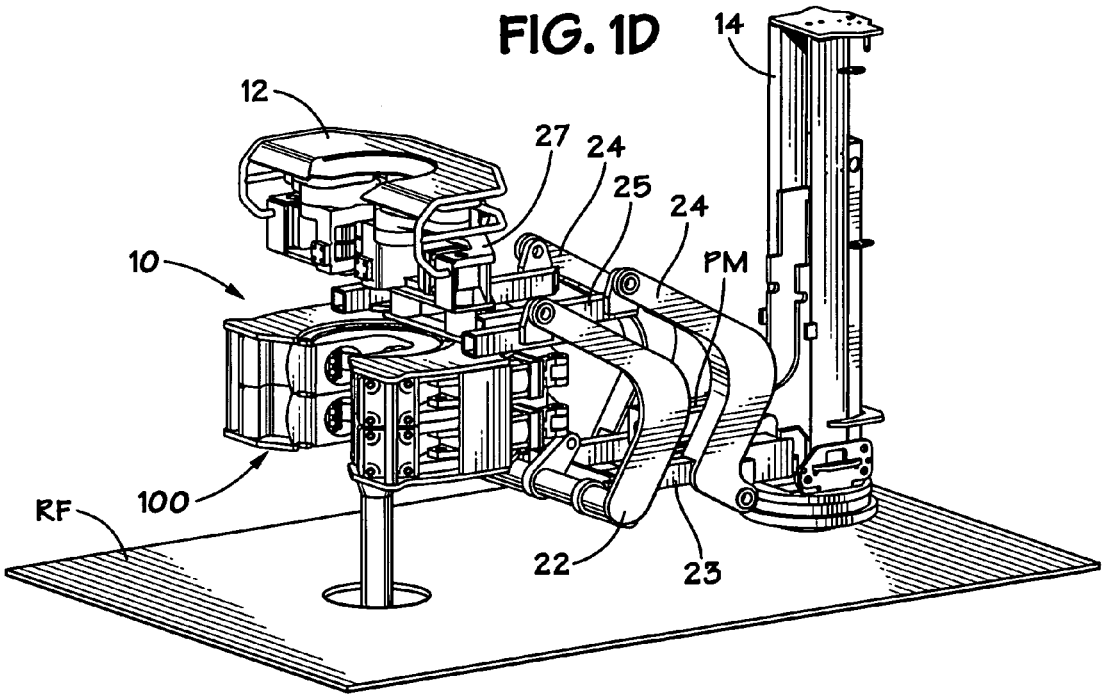
FIG. 1D is a perspective view of the system of FIG. 1A.
Figure 1B:
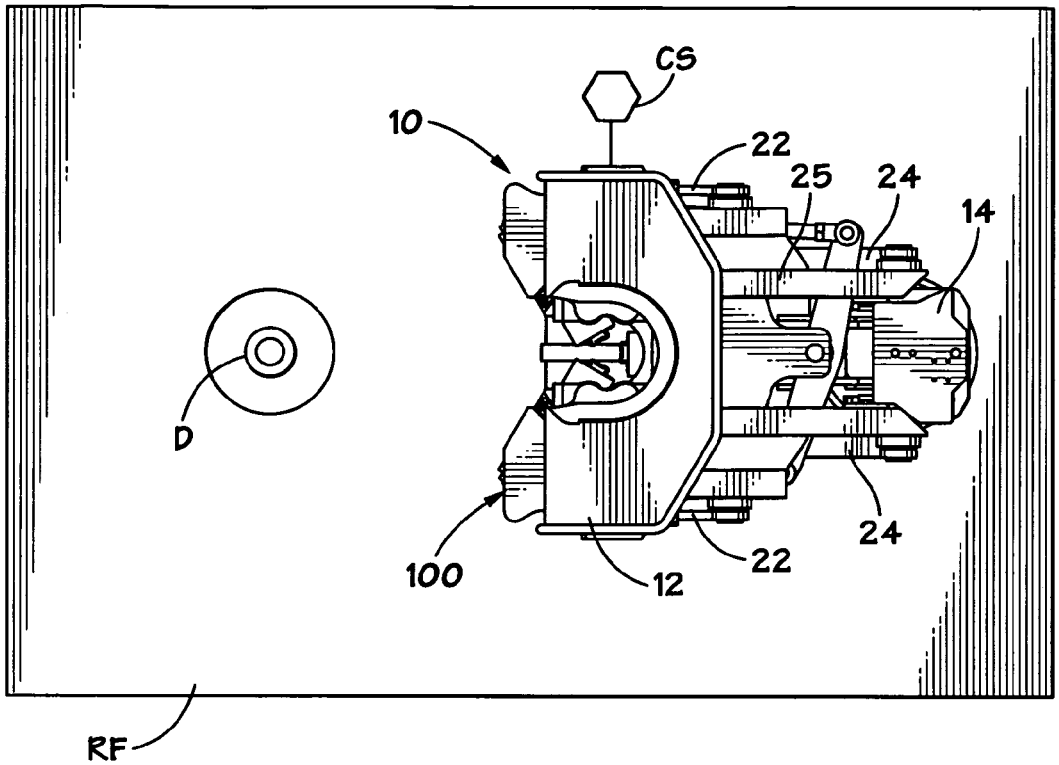
FIG. 1B is a top view of the system of FIG. 1A.
Figure 1C:
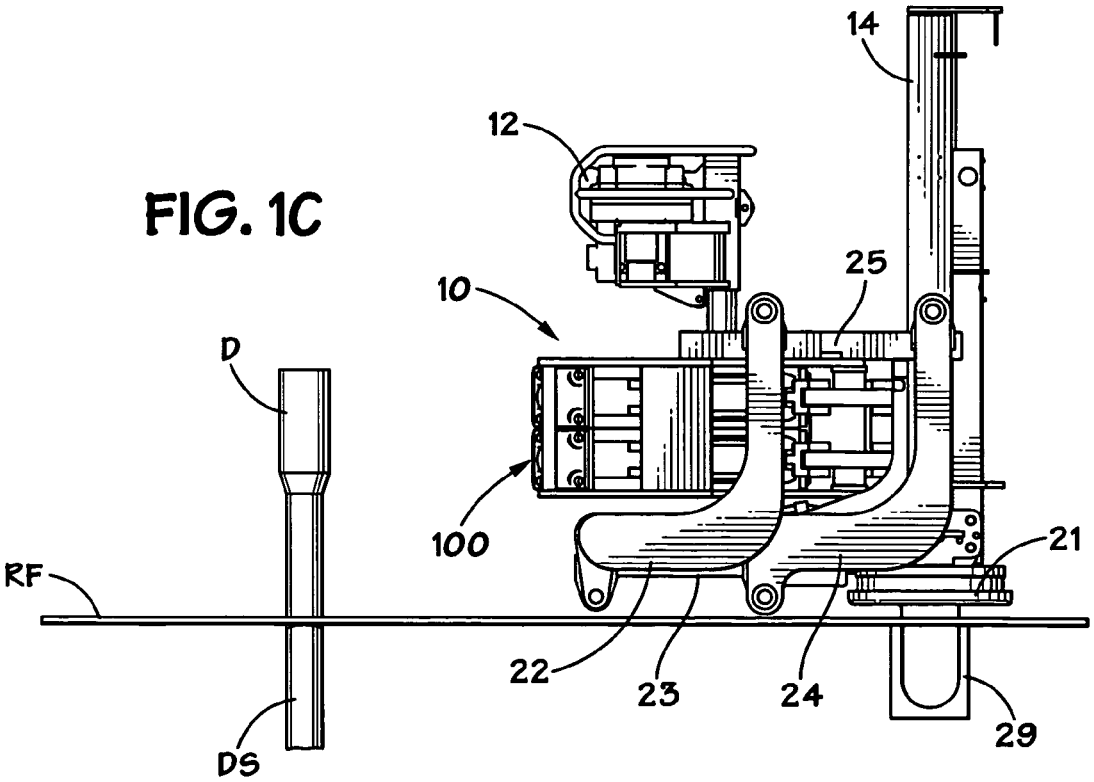
FIG. 1C is a side view of the system of FIG. 1A.
Figure 2A:
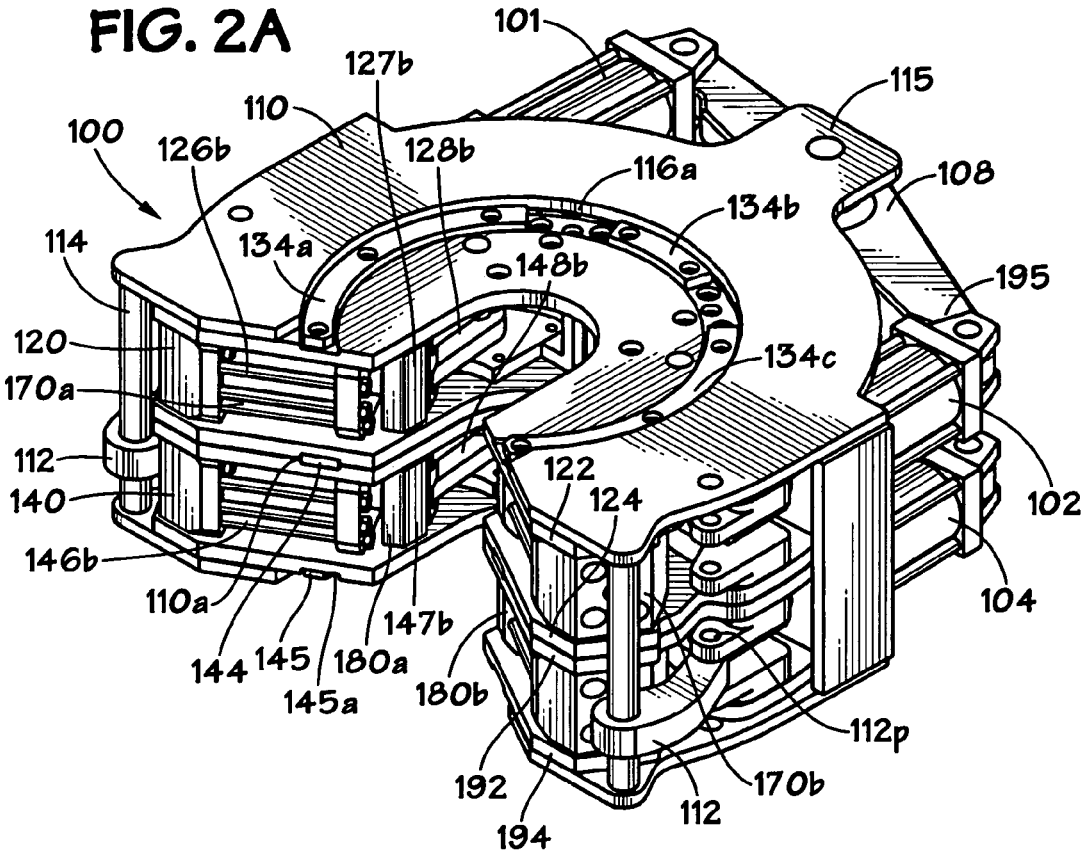
FIG. 2A is a perspective view of a torque wrench according to the present invention.
Figure 2B:
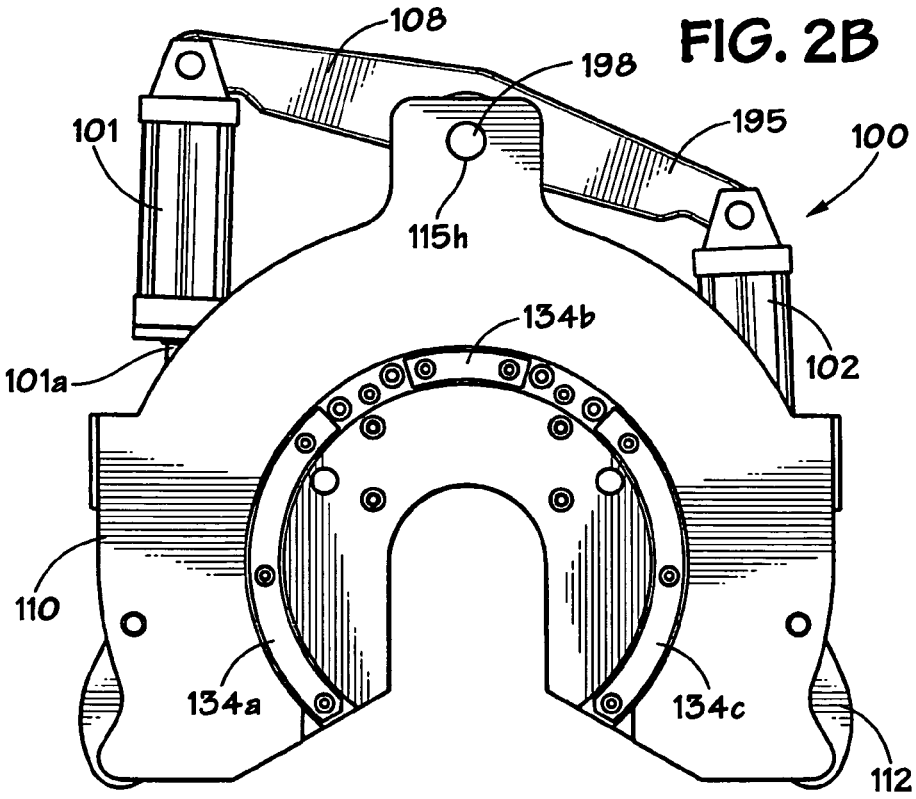
FIG. 2B is a top view of the torque wrench of FIG. 2A.
Figure 2C:
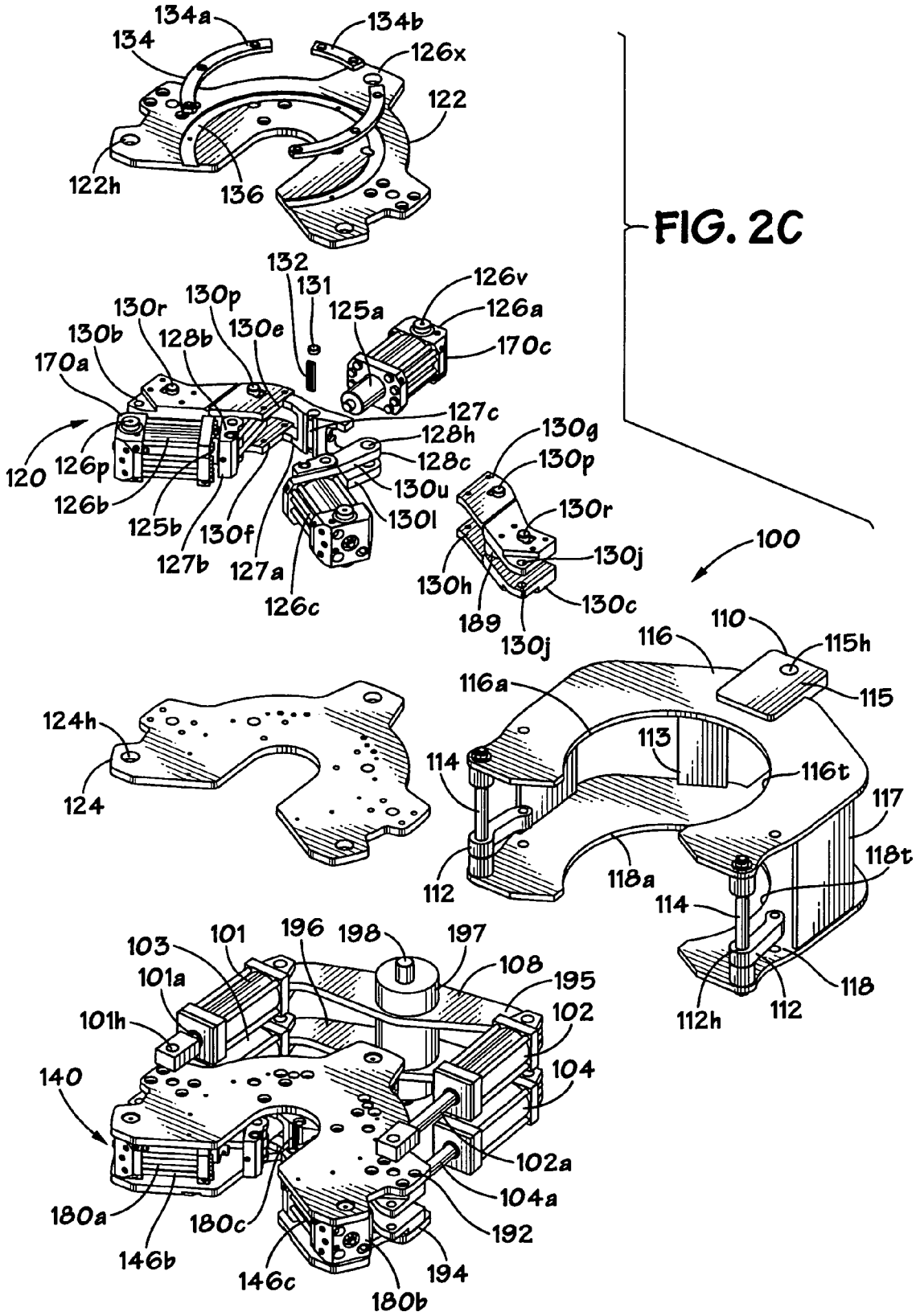
FIG. 2C is an exploded view of the torque wrench of FIG. 2A.
Figure 2D:
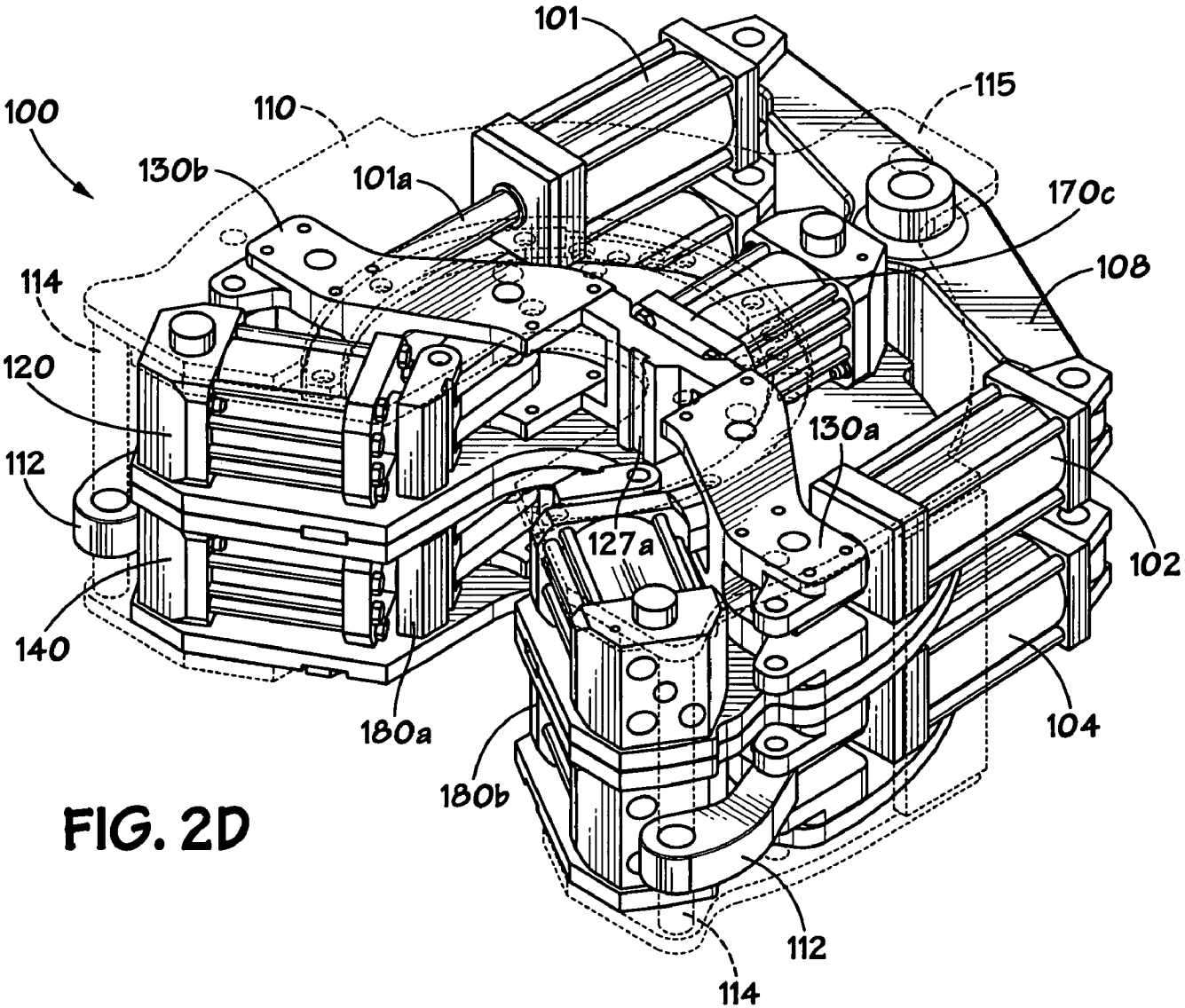
FIG. 2D is a cutaway perspective view of the torque wrench of FIG. 2A.
Figure 2F:
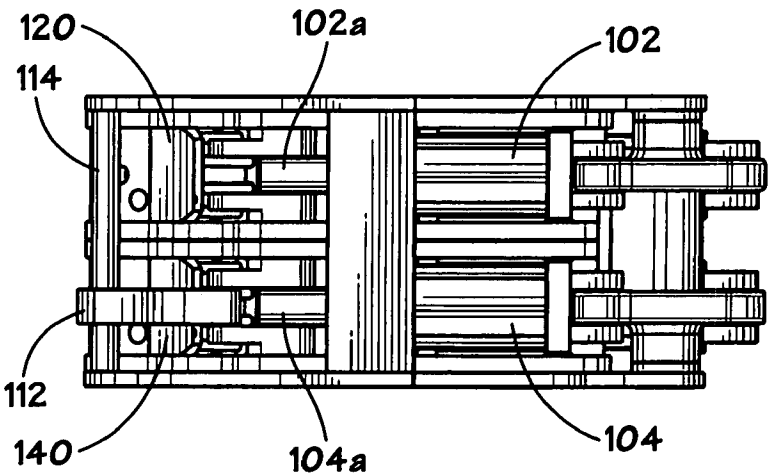
FIG. 2F is a side view of the torque wrench of FIG. 2D.
Figure 2E:
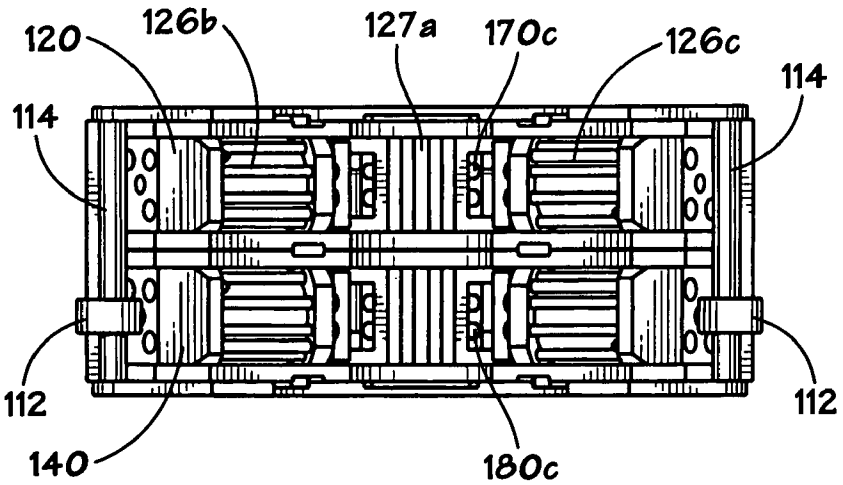
FIG. 2E is a front view of the torque wrench of FIG. 2D.

FIGS. 1A–1D show a system 10 according to the present invention which has a carriage 20 which is movably connected for up/down vertical movement to a column 14 and which can also translate horizontally on a rig floor RF for movement toward and away from a drill pipe D of a drill string DS in a well W. Support arms 22, 24 (two each) are pivotably connected at one end to a base 23 of the carriage 20 and at their other ends to a support 25. Optionally, only one support arm is used or two arms in parallel are used. A connector 21 is removably emplaceable in a socket 29 to mount the system on the rig. In one particular aspect the dual arms move the spinner/wrench combination outwardly 24" from the column 14 which results in a 6.5" rise vertically.

A torque wrench 100 according to the present invention and a spinner 12 are connected to a spin wrench carriage 27 on the support 25 and, are movable by a power mechanism PM toward and away from the column 14 by moving the support arms 22, 24. Optionally, a known torque wrench may be used instead of a torque wrench according to the present invention, e.g. instead of the torque wrench 100. Any suitable known spinner may be used, including, but not limited to, a spinner as disclosed in U.S. Pat. Nos. 4,348,920; 6,776,070; 4,221,269; 5,660,087; 4,446,761; 3,892,148; 4,023,449; and as disclosed in the prior art references cited in these patents. The spinner is movable up and down on the spin wrench carriage 25 toward and away from the torque wrench. A control console CS for the system 10 is shown schematically in FIG. 1B. Optionally, the console CS communicates by wire or wirelessly with the torque wrench 100 and/or is located remotely from it.

FIGS. 2A–2F illustrate the torque wrench 100 according to the present invention which has a frame 110 within which are a top jaw assembly 120 and a bottom jaw assembly 140. Gripping assemblies in each jaw assembly are rotated by corresponding torque cylinders. Each jaw assembly has torque cylinders for rotating a tubular gripped by the jaw assembly. Torque cylinders 101 and 102 move upper gripping assemblies 170*a*, 170*b*, 170*c*, and torque cylinders 103, 104 move lower gripping assemblies 180*a*, 180*b*, 180*c*. Gripping assemblies 170*a*, 170*b*, 180*a*, and 180*b* are front gripping assemblies. The gripping assemblies 170*c* and 180*c* are rear gripping assemblies. Each torque cylinder (of assemblies 120, 140) has a first end pivotably mounted to a rocker arm structure 108 and a second end pivotably mounted to a corresponding spacer clevis of a gripping assembly. Each spacer clevis (of assemblies 120, 140) is bolted to a jaw plate with bolts.

Each front gripping assembly (of the assemblies 120, 140) includes a power cylinder, a die carrier, grip die, torque links, and a spacer clevis. Each power cylinder is pivotably mounted between jaw plates and has a die carrier to which torque links are connected. The torque links are pivotably connected at one end to a die carrier and at another end to a corresponding spacer clevis with pins 130*p*. Each spacer clevis is pivotably connected to a torque cylinder rod (101*a*, 102*a*, 103*a*, 104*a*). Thus movement of the rods 101*a*, 102*a*, 103*a*, 104*a* as described below results in rotation of the gripping assemblies and of a tubular gripped by them.

The front gripping assembly 170*a* is exemplary of the other gripping assemblies. A power cylinder 126*b* has a first end pivotably connected to and between an upper jaw plate 122 and a lower jaw plate 124 with trunnions 126*p* on the top and bottom of the power cylinder 126*b* which are received in holes 122*h* and 124*h* in the plates 122, 124. A die carrier 127*b* connected to a power cylinder shaft 125*b* has a tubular gripping die (or dies) 132 held in place by retaining screws (or "die cleat") 131. A torque link 128*b* pivotably connects the die carrier to a corresponding spacer clevis 130*b*. Each torque link has top and bottom pieces, e.g. pieces 130*u* and 1301 of the torque link 128*c*. The torque links bear loads so that the cylinder rods are isolated from such loads. A shaft 101*a* of the torque cylinder 101 is pivotably connected to the spacer clevis 130*b*. Holes 128*h* in the torque link 128*b* receive pins 130*p* projecting from the spacer clevis 130*b*. A shaft 101*a* of the torque cylinder 101 has a hole 101*h* which receives a pin 130*r* projecting from the spacer clevis 130*b* for pivotably connecting the shaft 101*a* to the spacer clevis 130*b*. Each die carrier is connected to a rod (e.g. the shaft 125*b*) that moves in and out of a power cylinder (see e.g. FIGS. 3 and 4). The dies bite into a tubular allowing the force of the torque cylinders to impart a tangential load (torque) on the tubular. The external clamping cylinders do not generate a tangential torque—they push the dies into the tubular. The great majority of this load is reacted through the torque link and thence to a spacer clevis, to the jaw plates, to the torque cylinders, and via the rocker arm apparatus to the other jaw assembly. A third of the load is reacted through each torque link.

The rear gripping assembly 170*c* is like the rear gripping assembly 180*c*. The rear gripping assembly 170*c* has a power cylinder 126*a* with a movable shaft 125*a* having connected thereto a die carrier 127*c* with a die (or dies) 132 held in place with a screw 131. The rear die carrier's movement is guided by abutting contact with edges 130*e*, 130*f* of the spacer clevis 130*b* and edges 130*g*, 130*h* of the spacer clevis 130*c*. Pins 126*v* on the top and the bottom of the power cylinder 126*a* (one pin 126*v*, the top pin, shown in FIG. 2C; the bottom pin is similarly located and projects from the bottom of the power cylinder 126*a*) project, respectively, into holes in the upper plate and in the lower plate for mounting the power cylinder 126*a* to the plates 122, 124.

The upper jaw plate 122 has a groove 136 which receives centralizing pilot structure 134 which includes pieces 134*a*, 134*b*, and 134*c* connected to the upper jaw plate 122. The centralizing pilot structure 134 is used to maintain the top jaw assembly 120 in a desired central position in the torque wrench 100. An upper part of the pieces 134*a*, 134*b* and 134*c* projects into a throat 116*t* of an upper frame plate 116 of the wrench frame 110. Preferably there is clearance between a wall 116*a* of the throat 116*t* and the outer edges of the pieces 134*a*–134*c*. Similar structure centers the lower jaw assembly 140, including a piece or pieces 144 (see FIG. 2A) and corresponding grooves in the lower jaw plate 124 and in an upper jaw plate 192 of the lower jaw assembly 140. Also a piece (or pieces) 145 in a groove 145*a* projecting down within a wall 118*a* of a throat 118*t* of a lower frame plate 118 of the wrench frame 110 centralize the lower jaw plate with respect to the wall 118*a* (as the pieces 134*a*–134*c* centralize the upper jaw plate 122 with respect to the wall 116*a*).

The rocker arm structure 108 has a main post 197 to which are connected an upper arm 195 and a lower arm 196. The torque cylinders 101, 102 are connected to the arm 195 and the torque cylinders 103, 104 are connected to the arm 196. Pins 198 are received in holes 115*h* in the upper and lower frame plates 116, 118 to pivotably secure the post 197 to the wrench frame 110.

Rods 114 of the wrench frame 110 pass through holes 112*h* in grounding links 112. The grounding links 112 are movable up and down on the rods 114; rotatable with respect to the rods 114; and provide a connection between the wrench frame 110 and one of the jaw assemblies 120 or 140, for reasons described below. As shown, for example, in FIGS. 2A and 2D, the grounding links 112 are pinned with pins 112*p* to corresponding spacer clevises to selectively connect the lower jaw assembly 140 to the wrench frame 110; thus preventing the jaw assembly 140 from moving with respect to the wrench frame 110 and allowing the torque cylinders to turn an entire jaw plate with its gripping assemblies to rotate a tubular gripped by the gripping assemblies. The pin 112*p* passes through corresponding holes 130*j* in the spacer clevis. As desired, the grounding links 112 can be disconnected from the spacer devises of the lower jaw assembly 140; raised on the rods 114; and then connected to the spacer devises of the upper jaw assembly 120 to render the jaw assembly 120 immobile with respect to the wrench frame while freeing the lower jaw assembly 140 for movement.

The wrench frame 110 has side members 117 and a rear member 113 connected to and between the upper and lower frame plate 116, 118 with mounting bodies 115 (top and bottom; one, shown, FIG. 2C) having the holes 115*h*. The wrench frame supports the jaw assemblies vertically, aligns their axes, and prevents rotation of either. The upper jaw assembly or the lower jaw assembly with the grounding links (which are attached to the lower jaw assembly in typical operations so only the upper jaw assembly can rotate). For bit breaking and similar operations, the grounding links are moved to the upper jaw assembly and connected thereto.

Figure 4:
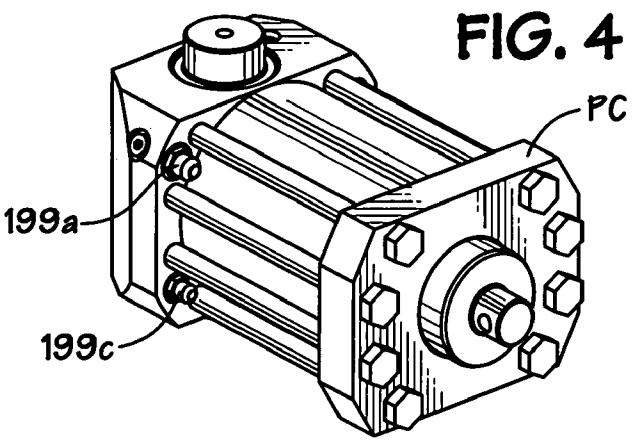
FIG. 4 is a perspective view of a clamp cylinder of the torque wrench of FIG. 2A
Figure 3:
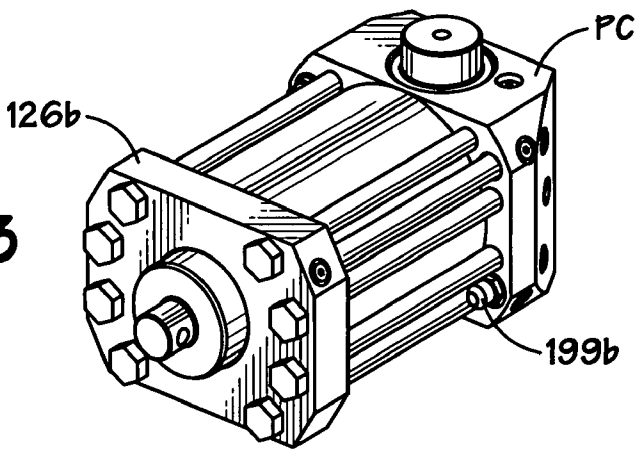
FIG. 3 is a perspective view of a clamp cylinder of the torque wrench of FIG. 2A.
Figure 2G:
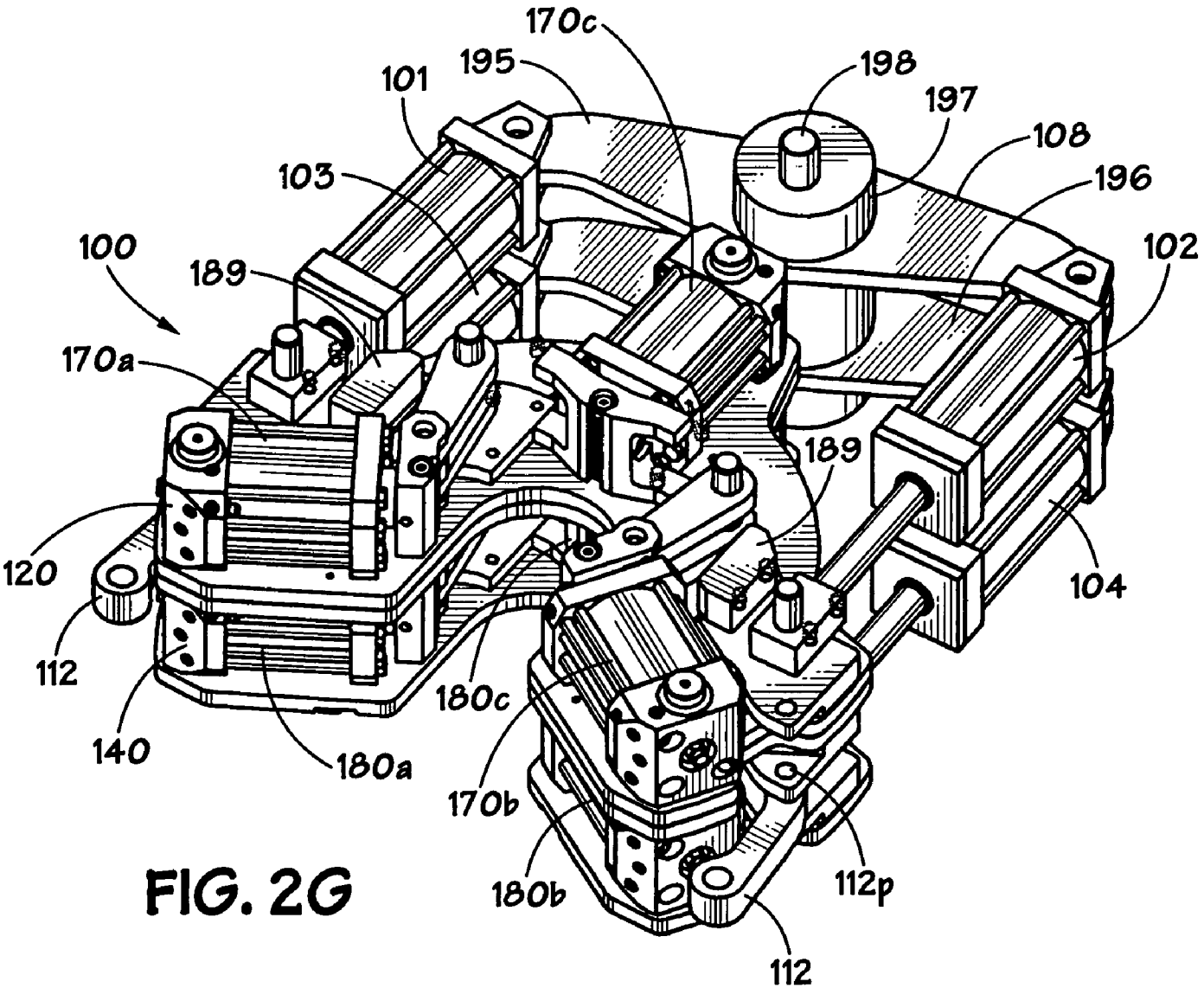
FIG. 2G is a perspective view, partially cut away, of the torque wrench of FIG. 2A.

As shown in FIGS. 3 and 4 a power cylinder PC (e.g. like the power cylinder of the upper and lower jaw assemblies) has a port 199*a* through which fluid under pressure is provided to the power cylinder to extend the power cylinder's shaft; a port 199*b* through which fluid is evacuated from the power cylinder to retract the power cylinder's shaft; and, optionally, a port 199*c* through which relatively high pressure fluid is provided, e.g., in one aspect, at 5000 psi, to increase clamping force and to further impress the dies onto a tubular.

Typical known systems are used to provide fluid under pressure to the power cylinders of the jaw assemblies.

In one aspect, fluid under pressure, e.g. ranging between 200 and 2500 psi, is supplied from a fluid source, (e.g. a dedicated source used with a system like the system 10 or an existing source on, e.g., a drilling rig), to a flow divider apparatus which has three positive displacement pumps, e.g., but not limited to, three gear pumps, operated by a common shaft 205 that provide power fluid to corresponding power cylinders.

Use of a common shaft insures that each pump produces the same flow of fluid to its corresponding power cylinder and the die carriers are moved in and out simultaneously and in synchronization. Synchronized motion of the die carriers is achieved resulting in centering of a tubular between the three die carriers. Even if unbalanced forces are initially applied to the power cylinders, synchronized motion and ensuing centering of a tubular between the die carriers results. In a typical operation the system 10 is initially positioned so that the rear power cylinders and their dies contact a tubular to be gripped and rotated while one or both of the front dies of the front power cylinders may not yet be in contact with the tubular—and forces on the tubular from the three gripping assemblies of each jaw assembly are, therefore, unbalanced. By providing the same flow volume to each of the three same-level gripping assemblies, one or the other of the gripping assemblies moves so that the distances are equal and, in doing so, a tubular which is initially off-center is pushed to the center. The rear die then pushes off until the front dies contact the tubular, resulting in centering of the tubular.

FIGS. 5A–9B illustrate a variety of methods according to the present invention which can be accomplished with a system 10 according to the present invention and a torque wrench according to the present invention, e.g. like the torque wrench 100. When one or the other of the jaw assemblies clamps onto a tubular, the clamping forces of that jaw assembly's power cylinders are reacted through the power cylinders into the upper and lower jaw plates. Torquing loads on the dies are transmitted through the die carriers, torque links, spacer clevises, power cylinders and to the associated rocker arm, through the other rocker arm, to the jaw assembly at the other level. There are no external loads beyond the wrench frame.

As shown in FIGS. 5A–5D, the upper and lower jaw assemblies of the torque member 100 are aligned and the die carriers are retracted. Fully stroking the upper and lower torque cylinders in the same direction results in the alignment of the upper and lower jaw assemblies. This can be achieved in a first mode in which the torque cylinder 101 is retracted, the torque cylinder 102 is extended, the torque cylinder 103 is retracted, and the torque cylinder 104 is extended. Alternatively, this can be achieved in a second mode in which the torque cylinder 101 is extended, the torque cylinder 102 is retracted, the torque cylinder 103 is extended, and the torque cylinder 104 is retracted. The method steps described below for the steps of FIGS. 6A–9B are done from an initial position in the first mode; but it is to be understood that, beginning in the second mode, the same steps can be achieved by reversing the torque cylinders (as compared to their positions in the first mode).

With the jaw assemblies aligned and the die carriers retracted, as shown in FIGS. 5A–5D, a tubular connection, e.g. two pieces of drill pipe threadedly connected together, can be received within the torque wrench 100. From the position illustrated in FIGS. 5A–5D (in the first mode), if the torque cylinder 101 is extended, the torque cylinder 102 is retracted, the lower jaw assembly is grounded to the wrench frame, the rocker arm apparatus cannot move and, therefore, the upper torque wrench must move (rotate counter clockwise as viewed from above). Alternatively from the position of FIGS. 5A–5D if the torque cylinder 103 is extended and the torque cylinder 104 is retracted, the lower jaw assembly will, unsuccessfully, attempt to turn the torque wrench, but it cannot because the lower jaw assembly is grounded to the frame and, therefore, the rocker arm apparatus does move and the upper jaw assembly moves accordingly.

Figure 6A:
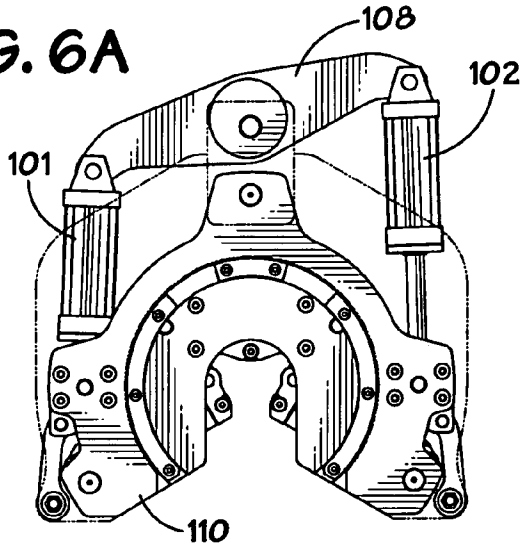
FIG. 6A is a top view of the torque wrench of FIG. 2A.
Figure 6B:
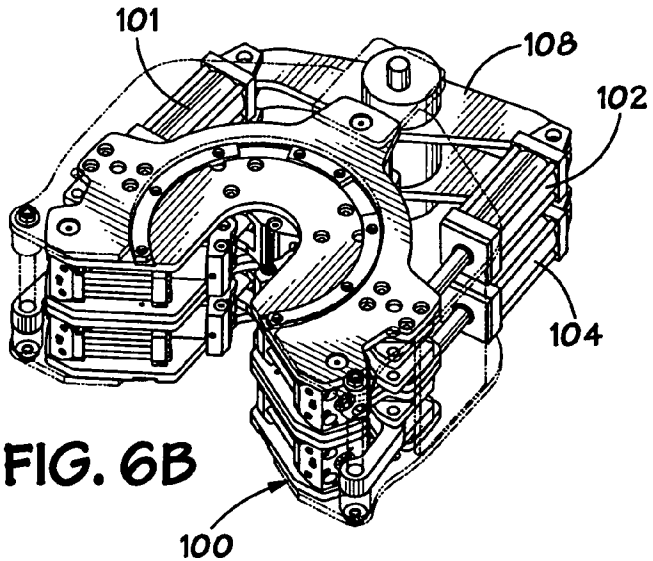
FIG. 6B is a perspective view of the torque wrench of FIG. 2A.
Figure 5A:
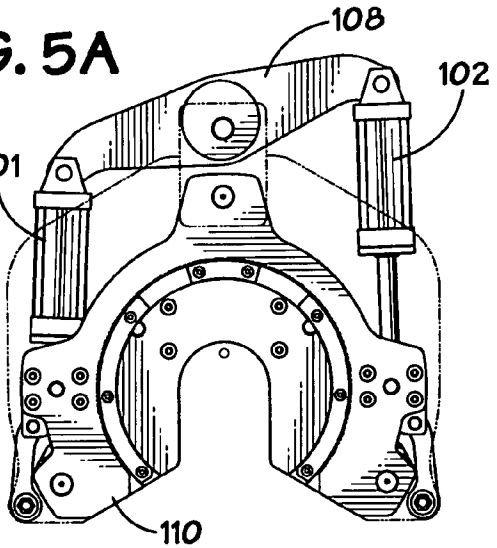
FIG. 5A is a top view of the torque wrench of FIG. 2A.
Figure 5B:
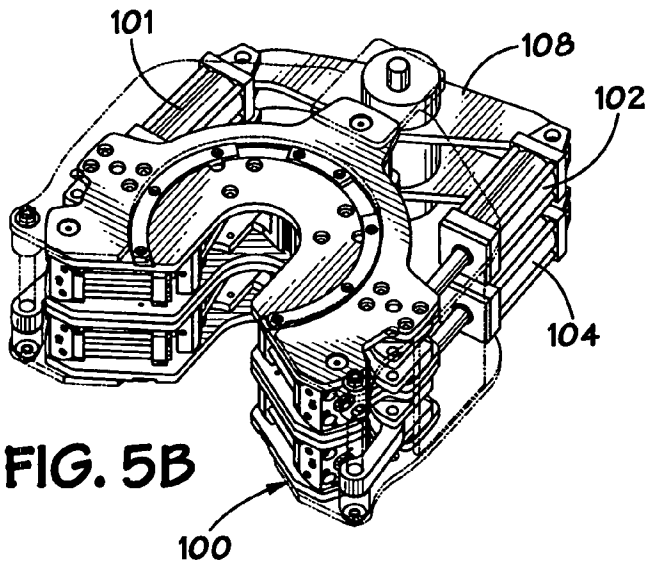
FIG. 5B is a perspective view of the torque wrench of FIG. 2A.
Figure 5C:
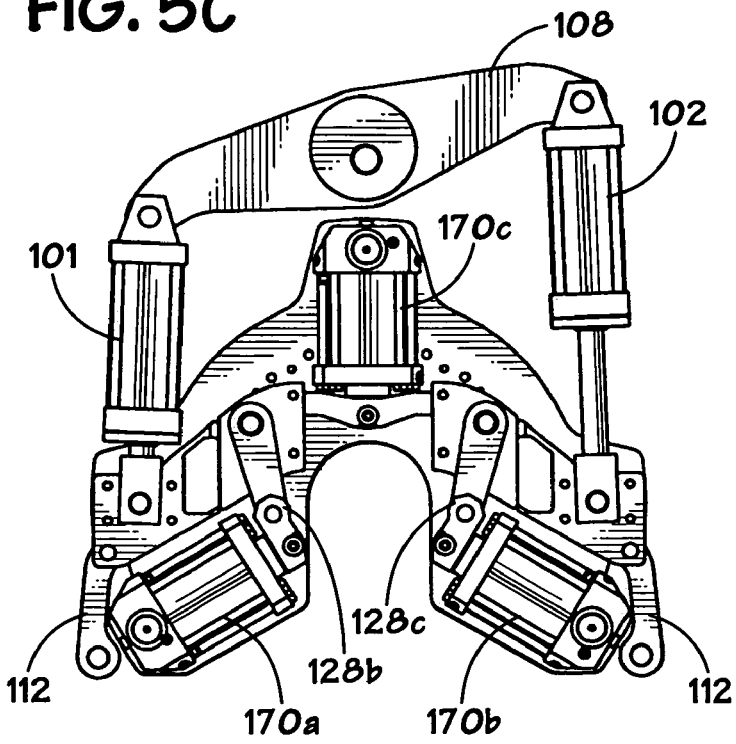
FIG. 5C is a top cutaway view of the torque wrench of FIG. 2A.
Figure 5D:
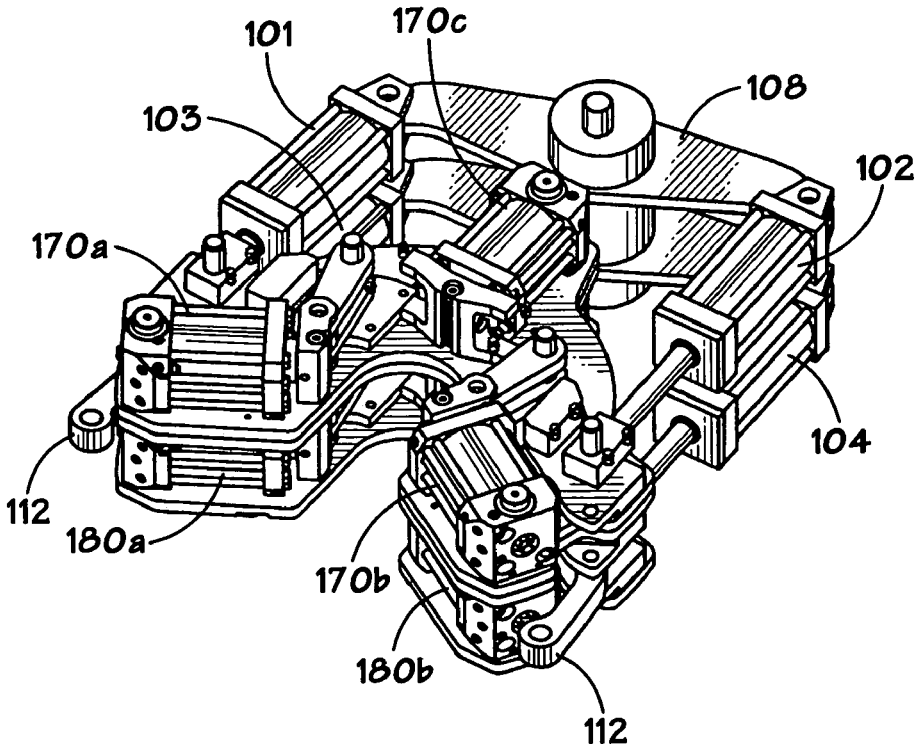
FIG. 5D is a perspective cutaway view of the torque wrench of FIG. 2A.

As shown in FIGS. 6A and 6B, the die carriers of both the upper and lower jaw assemblies are moved by their respective power cylinders to clamp the tubular. For this step the torque cylinders are in the same positions as in FIG. 5A.

Figure 7A:
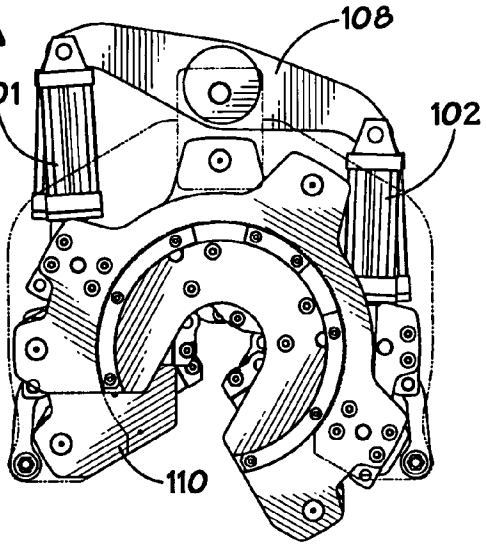
FIG. 7A is a top view of the torque wrench of FIG. 2A.
Figure 7B:
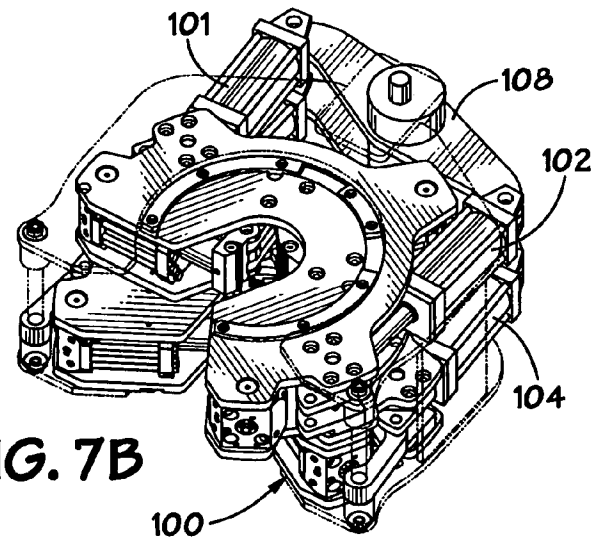
FIG. 7B is a perspective view of the torque wrench of FIG. 2A.
Figure 8C:
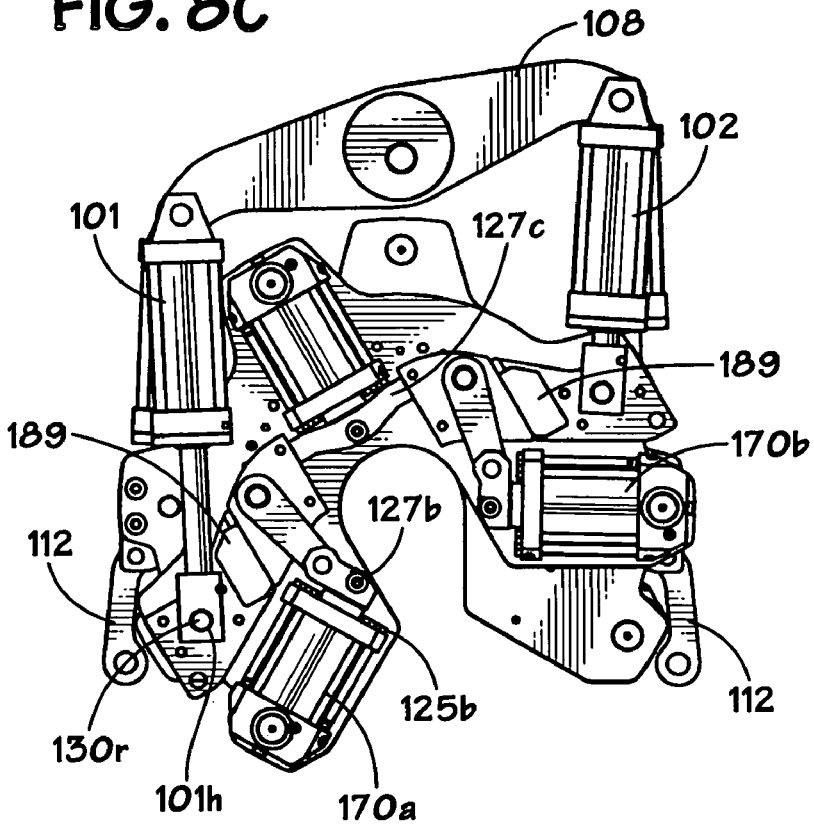
FIG. 8C is a top cutaway view of the torque wrench of FIG. 2A.
Figure 8D:
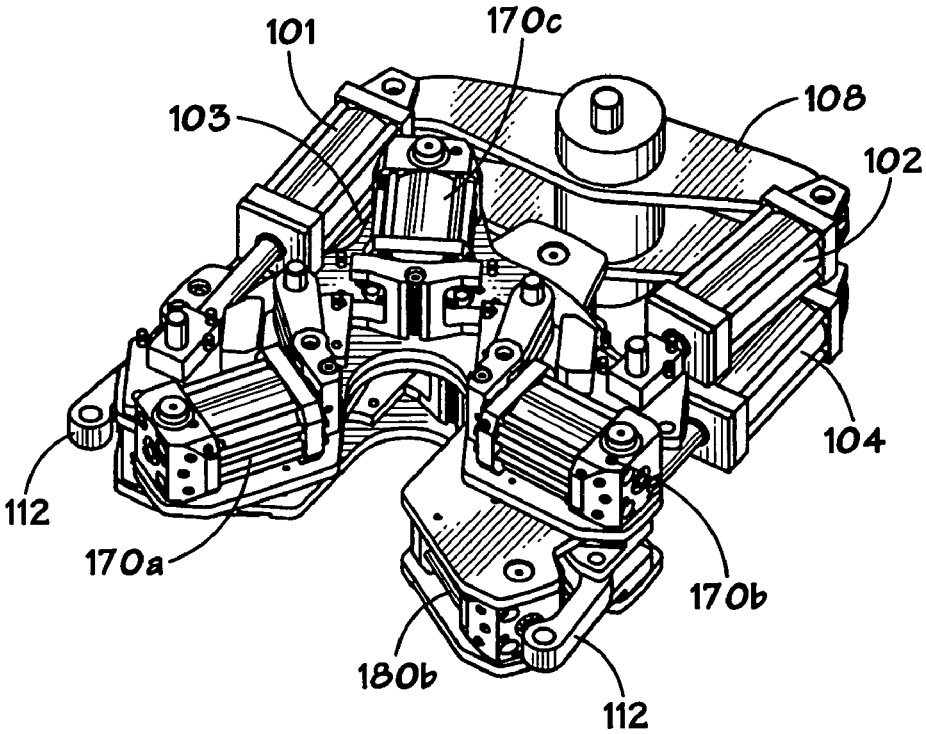
FIG. 8D is a perspective cutaway view of the torque wrench of FIG. 2A.

FIGS. 7A and 7B illustrate the making of a threaded connected between two tubulars, (e.g. between two threadedly connected pieces of drill pipe, an upper piece and a lower piece). The spinner spins the two pieces together to a certain extent without a final make-up torque so that the torque wrench's jaw assemblies can apply the final make-up torque. The spun-up connection is positioned so that the upper jaw assembly can grip the upper piece and the lower jaw assembly grips the lower piece. To apply the final torque to the connection, to turn the upper piece clockwise with respect to the lower piece, the lower jaw assembly is grounded to the wrench frame with the grounding links and the upper jaw assembly is rotated clockwise. This is accomplished by retracting torque cylinder 101, extending torque cylinder 102, extending torque cylinder 103, and retracting torque cylinder 104. The force applied to the pipe by the upper jaw assembly is reacted to the lower jaw plate and lower jaw assembly via the rocker arm apparatus. In the event the 30° of rotation accomplished in the previously-described steps is insufficient to make-up the connection (e.g. as indicated by an end of stroke sensor moved to a torque cylinder), the torque reading drops to zero indicating make-up has not been effected. In an embodiment of such a tool that is automatic, such a zero signal recycles and torquing would continue. An operator can then counter rotate prior to clamping onto the tubular for further rotation, i.e. the jaws are unclamped, stroked in the opposite direction, reclamped, and then torquing of the connection continues.

Figure 8A:
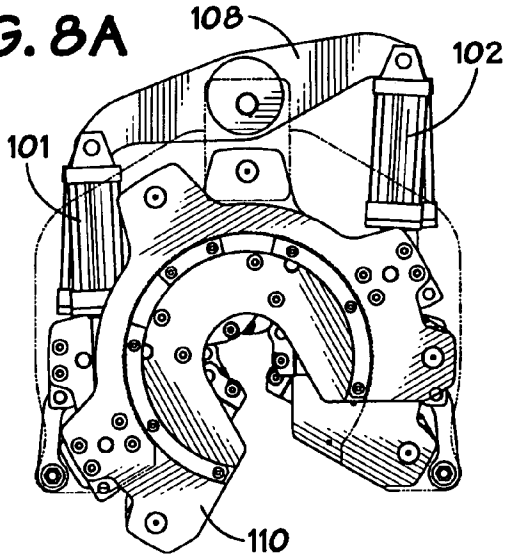
FIG. 8A is a top view of the torque wrench of FIG. 2A.
Figure 8B:
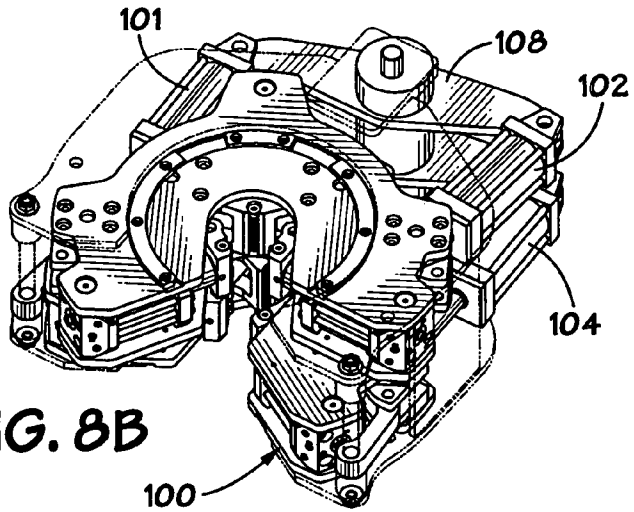
FIG. 8B is a perspective view of the torque wrench of FIG. 2A.

FIGS. 8A and 8B illustrate breaking a threaded connection between two threadedly connected tubulars, e.g. the two pieces of drill pipe made up in the method as shown in FIGS. 7A and 7B. The jaw assemblies are initially aligned as in FIG. 5A and the threaded connection is received within the torque wrench. To permit turning of the upper piece of drill pipe in the counter clockwise direction, to break the connection, the torque cylinder 101 is extended, the torque cylinder 102 is retracted, the torque cylinder 103 is retracted, and the torque cylinder 104 is extended. With the gripping assemblies of the upper jaw assembly clamped on the pipe, the upper jaw plate and its gripping assemblies are rotated and the forces generated are reacted through the rocker and apparatus to the lower jaw plate and its gripping assemblies.

FIGS. 10A, 10B, 11A and 11B illustrate an item breaking method in which a wellbore item, e.g. a bit or a connection for a device which is threadedly connected to a tubular member is disconnected therefrom. For example, to break a threaded connection, e.g. between a drill bit 200 and a drill collar 202 or between a tubular member and a mud motor, a breaking plate 204 is attached to the wrench frame 110*a*, e.g. part of the breaking plate 204 is inserted into an opening 206. The jaw assemblies of the torque wrench are initially aligned as in FIG. 5A. The grounding links are switched to free the lower jaw assembly and to connect the upper jaw assembly to the wrench frame so that the lower jaw assembly can be used to break the connection. The threaded connection is received within the torque wrench (see FIGS. 10A, 10B) and the die carriers of the lower jaw assembly are moved to grip the drill collar while the bit 200 (see FIGS. 10A and 10B) is held within the breaking plate 204. The drill collar 202 is rotated counter clockwise (with the torque cylinder 103 extended, the torque cylinder 104 retracted, the torque cylinder 101 retracted, and the torque cylinder 102 extended). In this step the torque applied to the tubular by rotation of the lower jaw assembly is reacted through the upper jaw assembly, into the wrench frame and then into the bit 200, thereby unscrewing the drill collar 202. Once the connection with the bit is broken, the spinner spins the tubular (drill collar 202) from the bit. Similarly, a bit or other item can be connected to a threaded tubular by reversing this method. In one aspect, a mud motor is disconnected from a drill collar by gripping the bottom of the mud motor with the system's lower jaw assembly and then rotating with the upper jaw assembly. In this case, the upper jaw is pinned to the frame, thereby forcing the lower jaw to rotate. The bit is installed in a torquing frame, which is grounded to the frame, thereby rotating the end of the mud motor into the stationary bit.

Figure 10A:
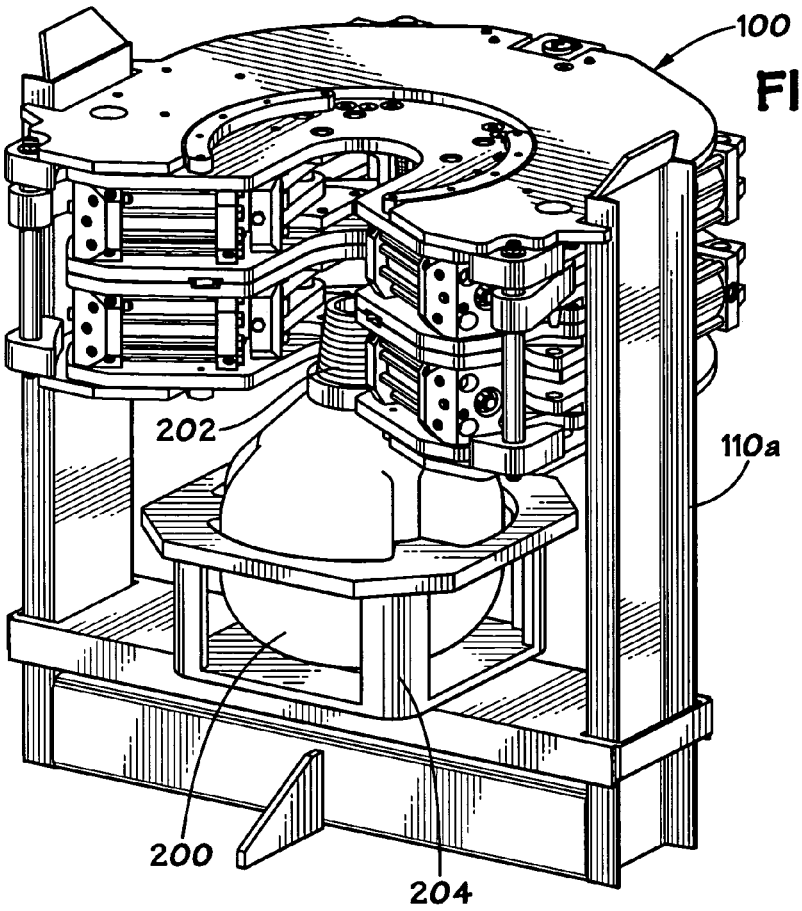
FIG. 10A is a perspective view of a system according to the present invention.
Figure 10B:
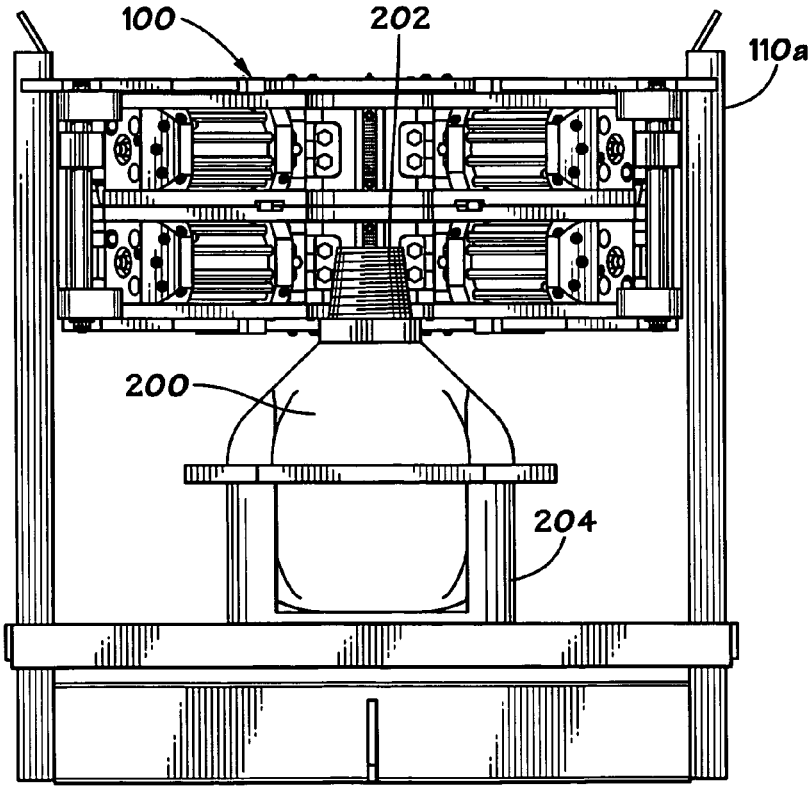
FIG. 10B is a front view of the system of FIG. 10A.
Figure 10C:
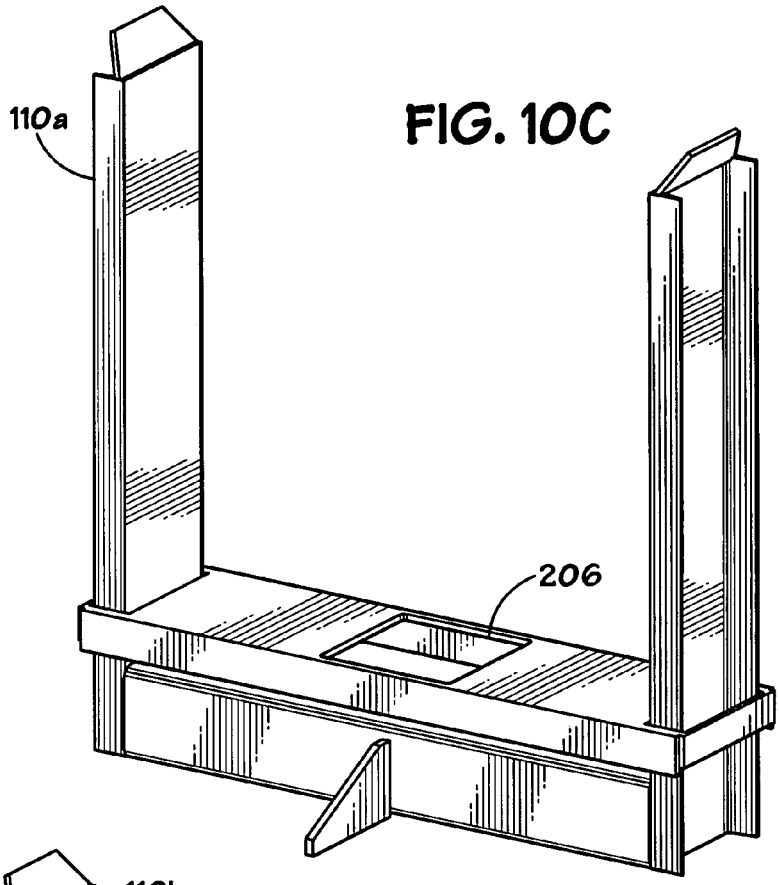
FIG. 10C is a perspective view of part of the system of FIG. 10A.
Figure 11C:
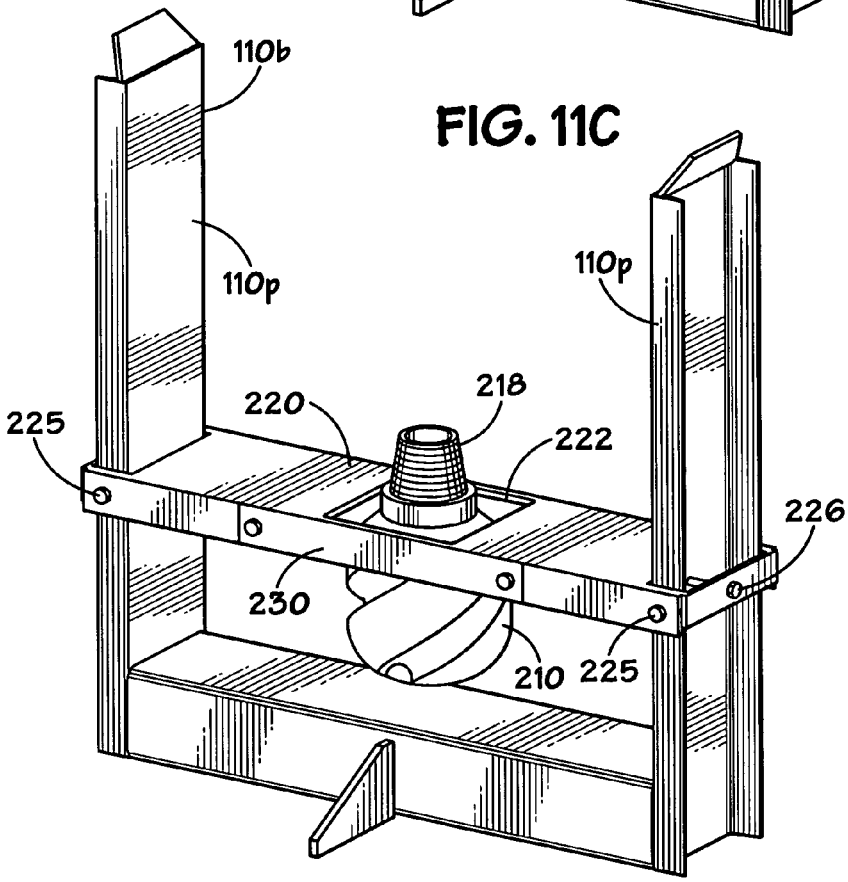
FIG. 11C is a perspective view of part of the system of FIG. 11A.
Figure 11A:
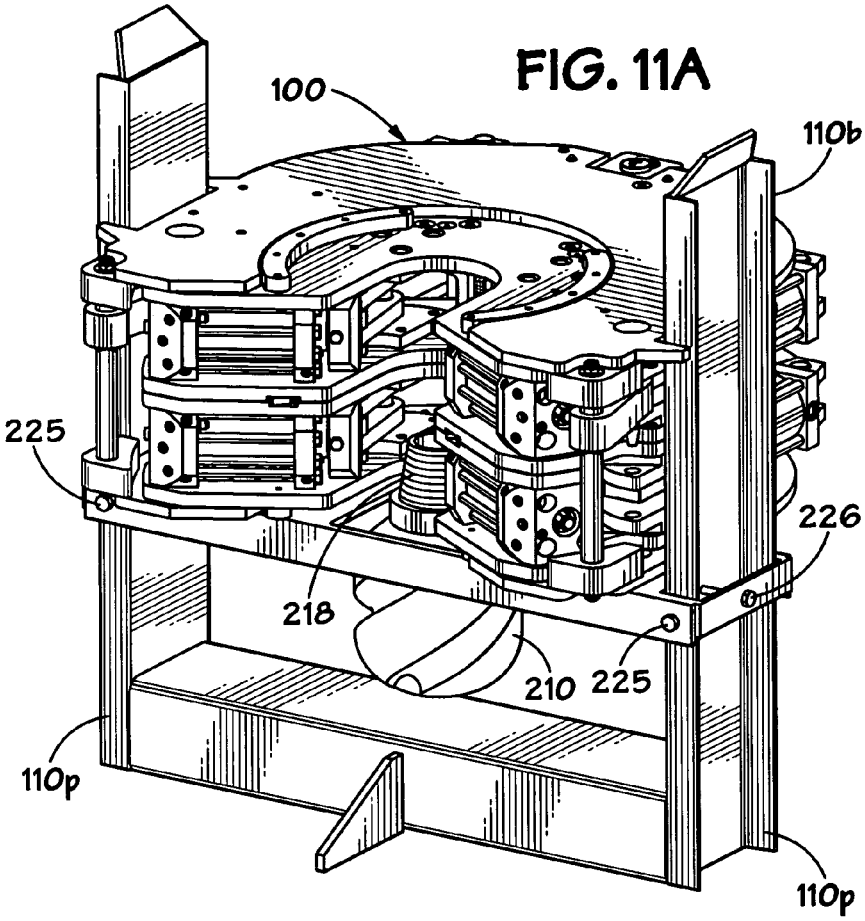
FIG. 11A is a perspective view of a system according to the present invention.
Figure 11B:
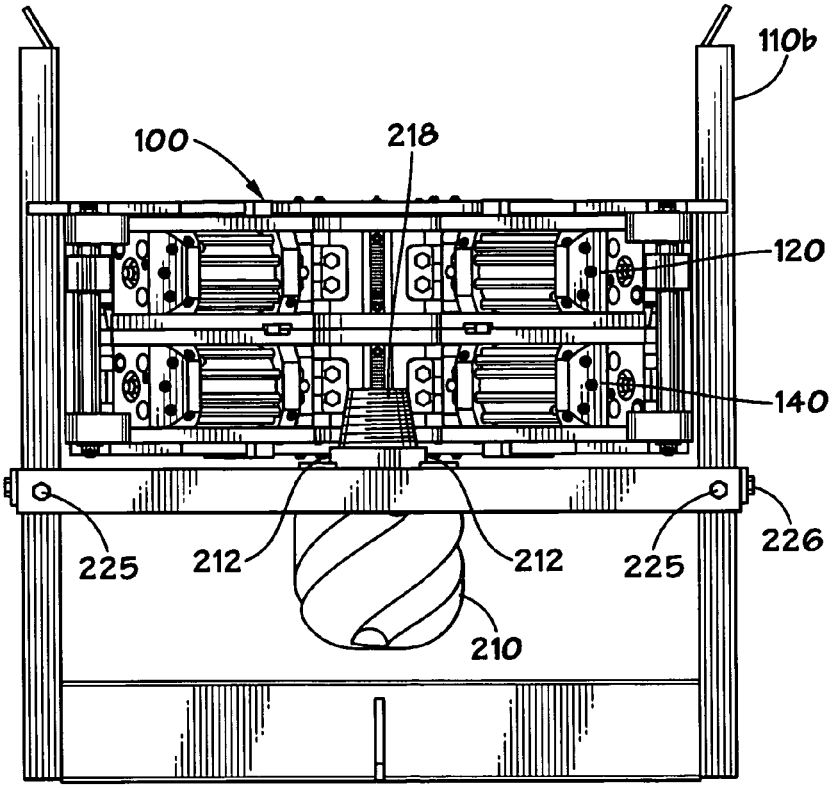
FIG. 11B is a front view of part of the system of FIG. 11A.

FIGS. 11A–11C illustrate a system according to the present invention like that of FIGS. 10A–10C (like numerals indicate like parts) in which no breaking plate 204 is needed to make and break a connection between a bit and a tubular, e.g. a drill collar threadedly connected to the tubular. A PDC bit 210 has grip flats 212 which correspond to the shape of an opening 222 in a plate 220. The plate 220 is movable up and down on posts 110*p* of a wrench frame 110*b* (like the wrench frame 110*a*, FIG. 10A). Using pins 225, 226 the plate 220 is positioned as desired on the wrench frame 110*b* to accommodate bits of a particular height. Optionally an openable gate 230 provides access to the opening 222 (corresponding to grip flats on a bit) to accommodate larger bits.

In operation, the PDC bit 210 is lowered into the opening 222 in the plate 220 and then the lower jaw assembly 140 of a torque wrench 100 grips the flats 212 of the bit. The upper jaw assembly 120 is then used to rotate a tubular, e.g. a drill collar, to make or break a connection with a threaded shaft 218 of the bit 210. A lip (not shown) on the plate 220 within the opening 222 may be used to support a bit. With certain tri-cone bits, the bit is positioned in a breaker box or plate on top of a plate 220 (with any interior lip for a PDC bit removed) corresponding to the bit and the bit is torqued from below.

Similarly, a mud motor (e.g. a rotor of a mud motor) can be gripped with a lower jaw assembly of a torque wrench of a system according to the present invention and a connection between the mud motor and a tubular threadedly connected thereto can be broken or made up.

Whenever a jaw assembly of a system according to the present invention clamps on a tubular, centralizing of the tubular with respect to the three dies of the die carriers and the biting of the dies into the tubular with equal force occurs. For example, a rear die carrier and a front die carrier of a system according to the present invention contact and bite into a tubular. To move a third die carrier into contact with the tubular, the flow of power fluid to each power cylinder associated with the dies is equal thereby causing the first two dies in contact with the tubular to push the tubular toward the third die as the third die also moves toward the tubular.

Any tubular gripping system or apparatus disclosed herein may be incorporated into any suitable known tong or tubular gripper, including, but not limited to, the subject matter of the U.S. Patents listed by number in paragraph 0008 above. Any tubular rotation system or apparatus disclosed herein may be incorporated into any suitable known tong or tubular gripper, including, but not limited to, the subject matter of the U.S. Patents listed by number in paragraph 0008 above.

In any method according to the present invention when a spinner is used to spin an upper tubular, both the upper and lower jaw assemblies can be unclamped from a lower tubular or the lower jaw assembly can be clamped to the lower tubular while the upper jaw assembly is unclamped.

The present invention, therefore, provides, in at least certain but not necessarily all embodiments, an apparatus for rotating a tubular, the apparatus having a frame; a rocker assembly connected to the frame, the rocker assembly including a top rocker arm pivotably mounted to the frame, and a bottom rocker arm pivotably mounted to the frame; top torque apparatus connected to the frame; upper gripper apparatus connected to the frame for gripping a primary tubular; lower gripper apparatus connected to the frame for gripping a secondary member; the upper gripper apparatus and lower gripper apparatus operable so that the lower gripper apparatus grips and holds the secondary member while the upper gripper apparatus grips and holds the primary tubular as the top torque apparatus is rotatable to rotate the primary tubular with respect to the secondary member; and torque generated by the top torque apparatus reacted through the upper gripper apparatus, through the top rocker arm, through the bottom rocker arm, and to the lower gripper apparatus.

The present invention, therefore, provides, in at least certain but not necessarily all embodiments, an apparatus for rotating a tubular, the apparatus including: a frame; a rocker assembly connected to the frame, the rocker assembly including a post, a top rocker arm, and a bottom rocker arm; the top rocker arm pivotably mounted to the post; the bottom rocker arm pivotably mounted to the post; top torque apparatus connected to the frame, including a first top torque cylinder apparatus and a second top torque cylinder apparatus; upper gripper apparatus connected to the frame for gripping a primary tubular, the upper gripper apparatus including a first upper gripper and a second upper gripper; the first upper gripper connected to the first top torque cylinder apparatus for movement thereby; the second upper gripper connected to the second top torque cylinder apparatus for movement thereby; bottom torque apparatus connected to the frame including a first bottom torque cylinder apparatus and a second bottom torque cylinder apparatus; lower gripper apparatus connected to the frame for gripping a secondary member, the lower gripper apparatus including a first lower gripper and a second lower gripper; the first lower gripper connected to the first bottom torque cylinder apparatus; the second lower gripper connected to the second bottom torque cylinder apparatus; the upper gripper apparatus and lower gripper apparatus operable so that the lower gripper apparatus grips and holds the secondary member while the upper gripper apparatus grips and holds the primary tubular as the top torque apparatus rotates the primary tubular with respect to the secondary member; and torque generated by the top torque apparatus reacted through the upper gripper apparatus, through the top rocker arm, through the bottom rocker arm, through the bottom torque apparatus, and to the lower gripper apparatus (or, vice versa, regarding torque generated by the bottom torque apparatus).

Such an apparatus may have one or some, in any possible combination, of the following: the upper gripper apparatus including three movable die carriers spaced around the frame, each die carrier with dies for gripping a tubular, and the lower gripper apparatus including three movable die carriers spaced around the frame, each die carrier with dies for gripping a tubular; wherein the movable die carriers of each gripper apparatus are equally spaced apart to reduce distortion of a tubular gripped by the gripper apparatuses; wherein the three movable die carriers of each gripper apparatus are movable to facilitate centering of a tubular within the apparatus for rotating a tubular; wherein the bottom torque apparatus is operable to rotate the secondary member; at least one grounding link movably connected to the frame for selectively linking to the frame the upper gripper apparatus or the lower gripper apparatus; the three movable die carriers of the upper gripper apparatus are mounted between a first upper plate and a first lower plate, the first upper plate and the first lower plate each having a throat through which an item is movable for gripping by the dies on the die carriers; the three movable die carriers of the lower gripper apparatus are mounted between a second upper plate and a second lower plate, the second upper plate and the second lower plate each having a throat through which an item is movable for gripping the dies on the die carriers; an interior groove on the frame, a piloting structure on the first upper plate, the piloting structure located in and movable in the interior groove to maintain a desired position of the first upper plate and of the upper gripper apparatus; an interior groove on the frame, a piloting structure on the lower plate, and the piloting structure located in and movable in the interior groove to maintain a desired position of the lower plate and of the lower gripper apparatus; wherein each torque cylinder apparatus has a movable cylinder rod and wherein each movable die carrier has a torque link movably connected thereto, each torque link also connected to a spacer clevis, each spacer clevis movably connected to a corresponding torque cylinder rod so that said torque cylinder rod is isolated from loads on the corresponding torque link; wherein the movable die carriers of each gripper apparatus are equally spaced apart to reduce distortion of a tubular gripped by the gripper apparatuses; and a third of a load from gripping a tubular is reacted through each torque link of a gripper apparatus; a carriage, the frame secured to the carriage so that the apparatus for rotating a tubular is secured to the carriage, and a spinner for spinning a tubular member, the spinner secured to the carriage above the apparatus for rotating a tubular member; wherein the spinner is movably connected to the carriage for up and down movement with respect to the apparatus for rotating a tubular member; a console adjacent the carriage for communication with the apparatus for rotating a tubular member; wherein the primary tubular is connected to a bit and the secondary member is part of the bit; and/or pivotable support structure pivotably connected to the carriage, the spinner and the apparatus for rotating a tubular connected to the pivotable support structure, and the pivotable support structure pivotable to move the spinner and to move the apparatus for rotating a tubular with respect to the carriage.

The present invention, therefore, provides, in at least certain but not necessarily all embodiments, an apparatus for rotating a tubular, the apparatus having a frame; a rocker assembly connected to the frame, the rocker assembly including a post, a top rocker arm, and a bottom rocker arm; the top rocker arm pivotably mounted to the post; the bottom rocker arm pivotably mounted to the post; top torque apparatus connected to the frame, including a first top torque cylinder apparatus and a second top torque cylinder apparatus; upper gripper apparatus connected to the frame for gripping a primary tubular, the upper gripper apparatus including a first upper gripper and a second upper gripper; the first upper gripper connected to the first top torque cylinder apparatus for movement thereby; the second upper gripper connected to the second top torque cylinder apparatus for movement thereby; bottom torque apparatus connected to the frame including a first bottom torque cylinder apparatus and a second bottom torque cylinder apparatus; lower gripper apparatus connected to the frame for gripping a secondary member, the lower gripper apparatus including a first lower gripper and a second lower gripper; the first lower gripper connected to the first bottom torque cylinder apparatus; the second lower gripper connected to the second bottom torque cylinder apparatus; the upper gripper apparatus and lower gripper apparatus operable so that the lower gripper apparatus grips and holds the secondary member while the upper gripper apparatus grips and holds the primary tubular as the top torque apparatus rotates the primary tubular with respect to the secondary member; torque generated by the top torque apparatus reacted through the upper gripper apparatus, through the top rocker arm, through the bottom rocker arm, through the bottom torque apparatus, and to the lower gripper apparatus; wherein the bottom torque apparatus is operable to rotate the secondary member; at least one grounding link movably connected to the frame for selectively linking to the frame the upper gripper apparatus or the lower gripper apparatus; a carriage; the frame secured to the carriage so that the apparatus for rotating a tubular is secured to the carriage; and a spinner for spinning a tubular member, the spinner secured to the carriage above the apparatus for rotating a tubular member.

The present invention, therefore, provides, in at least certain but not necessarily all embodiments, a method for rotating a primary tubular with respect to a secondary member, the method including gripping the primary tubular with an upper gripper apparatus of an apparatus for rotating a tubular according to the present invention, gripping the secondary member with a lower gripper apparatus of an apparatus according to the present invention, and with a top torque apparatus of an apparatus according to the present invention rotating the primary tubular with respect to the secondary member.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventor may rely on the Doctrine of Equivalents to determine and assess the scope of their invention and of the claims that follow as they may pertain to apparatus not materially departing from, but outside of, the literal scope of the invention as set forth in the following claims. Any patent or patent application referred to herein buy patent number or application number is incorporated fully herein for all purposes.

What is claimed is:

1. An apparatus for rotating a tubular, the apparatus comprising a frame, a rocker assembly connected to the frame, the rocker assembly including a top rocker arm pivotably mounted to the frame, and a bottom rocker arm pivotably mounted to the frame, top torque apparatus connected to the frame, upper gripper apparatus connected to the frame for gripping a primary tubular, lower gripper apparatus connected to the frame for gripping a secondary member, the upper gripper apparatus and lower gripper apparatus operable so that the lower gripper apparatus grips and holds the secondary member while the upper gripper apparatus grips and holds the primary tubular as the top torque apparatus is rotatable to rotate the primary tubular with respect to the secondary member, and torque generated by the top torque apparatus reacted through the upper gripper apparatus, through the top rocker arm, through the bottom rocker arm, and to the lower gripper apparatus.

2. An apparatus for rotating a tubular, the apparatus comprising a frame, a rocker assembly connected to the frame, the rocker assembly including a post, a top rocker arm, and a bottom rocker arm, the top rocker arm pivotably mounted to the post, the bottom rocker arm pivotably mounted to the post, top torque apparatus connected to the frame, including a first top torque cylinder apparatus and a second top torque cylinder apparatus, upper gripper apparatus connected to the frame for gripping a primary tubular, the upper gripper apparatus including a first upper gripper and a second upper gripper, the first upper gripper connected to the first top torque cylinder apparatus for movement thereby, the second upper gripper connected to the second top torque cylinder apparatus for movement thereby, bottom torque apparatus connected to the frame including a first bottom torque cylinder apparatus and a second bottom torque cylinder apparatus, lower gripper apparatus connected to the frame for gripping a secondary member, the lower gripper apparatus including a first lower gripper and a second lower gripper, the first lower gripper connected to the first bottom torque cylinder apparatus, the second lower gripper connected to the second bottom torque cylinder apparatus, the upper gripper apparatus and lower gripper apparatus operable so that the lower gripper apparatus grips and holds the secondary member while the upper gripper apparatus grips and holds the primary tubular as the top torque apparatus rotates the primary tubular with respect to the secondary member, and torque generated by the top torque apparatus reacted through the upper gripper apparatus, through the top rocker arm, through the bottom rocker arm, through the bottom torque apparatus, and to the lower gripper apparatus.

3. The apparatus of claim 2 wherein the upper gripper apparatus including three movable die carriers spaced around the frame, each die carrier with dies for gripping a tubular, and the lower gripper apparatus including three movable die carriers spaced around the frame, each die carrier with dies for gripping a tubular.

4. The apparatus of claim 3 wherein the movable die carriers of each gripper apparatus are equally spaced apart to reduce distortion of a tubular gripped by the gripper apparatuses.

5. The apparatus of claim 3 wherein the three movable die carriers of each gripper apparatus are movable to facilitate centering of a tubular within the apparatus for rotating a tubular.

6. The apparatus of claim 2 wherein the bottom torque apparatus is operable to rotate the secondary member.

7. The apparatus of claim 2 further comprising at least one grounding link movably connected to the frame for selectively linking to the frame the upper gripper apparatus or the lower gripper apparatus.

8. The apparatus of claim 2 wherein the three movable die carriers of the upper gripper apparatus are mounted between a first upper plate and a first lower plate, and the first upper plate and the first lower plate each having a throat through which an item tubular is movable for gripping by the dies on the die carriers.

9. The apparatus of claim 2 wherein the three movable die carriers of the lower gripper apparatus are mounted between a second upper plate and a second lower plate, and the second upper plate and the second lower plate each having a throat through which an item is movable for gripping by the dies on the die carriers.

10. The apparatus of claim 8 further comprising an interior groove on the frame, a piloting structure on the first upper plate, and the piloting structure located in and movable in the interior groove to maintain a desired position of the first upper plate and of the upper gripper apparatus.

11. The apparatus of claim 9 further comprising an interior groove on the frame, a piloting structure on the lower plate, and the piloting structure located in and movable in the interior groove to maintain a desired position of the lower plate and of the lower gripper apparatus.

12. The apparatus of claim 3 wherein each torque cylinder apparatus has a movable cylinder rod and wherein each movable die carrier has a torque link movably connected thereto, each torque link also connected to a spacer clevis, each spacer clevis movably connected to a corresponding torque cylinder rod so that said torque cylinder rod is isolated from loads on the corresponding torque link.

13. The apparatus of claim 3 wherein the movable die carriers of each gripper apparatus are equally spaced apart to reduce distortion of a tubular gripped by the gripper apparatuses; and a third of a load from gripping a tubular is reacted through each torque link of a gripper apparatus.

14. The apparatus of claim 2 further comprising a carriage, the frame secured to the carriage so that the apparatus for rotating a tubular is secured to the carriage, and a spinner for spinning a tubular member, the spinner secured to the carriage above the apparatus for rotating a tubular member.

15. The apparatus of claim 14 wherein the spinner is movably connected to the carriage for up and down movement with respect to the apparatus for rotating a tubular member.

16. The apparatus of claim 14 further comprising a console adjacent the carriage for communication with the apparatus for rotating a tubular member.

17. The apparatus of claim 2 wherein the primary tubular is connected to a bit and the secondary member is part of the bit.

18. The apparatus of claim 14 further comprising pivotable support structure pivotably connected to the carriage, the spinner and the apparatus for rotating a tubular connected to the pivotable support structure, and the pivotable support structure pivotable to move the spinner and to move the apparatus for rotating a tubular with respect to the carriage.

19. An apparatus for rotating a tubular, the apparatus comprising a frame, a rocker assembly connected to the frame, the rocker assembly including a post, a top rocker arm, and a bottom rocker arm, the top rocker arm pivotably mounted to the post, the bottom rocker arm pivotably mounted to the post, top torque apparatus connected to the frame, including a first top torque cylinder apparatus and a second top torque cylinder apparatus, upper gripper apparatus connected to the frame for gripping a primary tubular, the upper gripper apparatus including a first upper gripper and a second upper gripper, the first upper gripper connected to the first top torque cylinder apparatus for movement thereby, the second upper gripper connected to the second top torque cylinder apparatus for movement thereby, bottom torque apparatus connected to the frame including a first bottom torque cylinder apparatus and a second bottom torque cylinder apparatus, lower gripper apparatus connected to the frame for gripping a secondary member, the lower gripper apparatus including a first lower gripper and a second lower gripper, the first lower gripper connected to the first bottom torque cylinder apparatus, the second lower gripper connected to the second bottom torque cylinder apparatus, the upper gripper apparatus and lower gripper apparatus operable so that the lower gripper apparatus grips and holds the secondary member while the upper gripper apparatus grips and holds the primary tubular as the top torque apparatus rotates the primary tubular with respect to the secondary member, torque generated by the top torque apparatus reacted through the upper gripper apparatus, through the top rocker arm, through the bottom rocker arm, through the bottom torque apparatus, and to the lower gripper apparatus, wherein the bottom torque apparatus is operable to rotate the secondary member, at least one grounding link movably connected to the frame for selectively linking to the frame the upper gripper apparatus or the lower gripper apparatus, a carriage, the frame secured to the carriage so that the apparatus for rotating a tubular is secured to the carriage, and a spinner for spinning a tubular member, the spinner secured to the carriage above the apparatus for rotating a tubular member.

20. A method for rotating a primary tubular with respect to a secondary member, the method comprising gripping the primary tubular with an upper gripper apparatus of an apparatus for rotating a tubular, the apparatus for rotating a tubular comprising a frame, a rocker assembly connected to the frame, the rocker assembly including a post, a top rocker arm, and a bottom rocker arm, the top rocker arm pivotably mounted to the post, the bottom rocker arm pivotably mounted to the post, top torque apparatus connected to the frame, including a first top torque cylinder apparatus and a second top torque cylinder apparatus, upper gripper apparatus connected to the frame for gripping a primary tubular, the upper gripper apparatus including a first upper gripper and a second upper gripper, the first upper gripper connected to the first top torque cylinder apparatus for movement thereby, the second upper gripper connected to the second top torque cylinder apparatus for movement thereby, bottom torque apparatus connected to the frame including a first bottom torque cylinder apparatus and a second bottom torque cylinder apparatus, lower gripper apparatus connected to the frame for gripping a secondary member, the lower gripper apparatus including a first lower gripper and a second lower gripper, the first lower gripper connected to the first bottom torque cylinder apparatus, the second lower gripper connected to the second bottom torque cylinder apparatus, the upper gripper apparatus and lower gripper apparatus operable so that the lower gripper apparatus grips and holds the secondary member while the upper gripper apparatus grips and holds the primary tubular as the top torque apparatus rotates the primary tubular with respect to the secondary member, and torque generated by the top torque apparatus reacted through the upper gripper apparatus, through the top rocker arm, through the bottom rocker arm, through the bottom torque apparatus, and to the lower gripper apparatus, the method further comprising gripping the secondary member with the lower gripper apparatus, and with the top torque apparatus rotating the primary tubular with respect to the secondary member.

* * * * *